US005472455A

United States Patent [19]

Mehreteab et al.

[11] Patent Number: 5,472,455

[45] **Date of Patent: * Dec. 5, 1995**

[54] ANIONIC/CATIONIC SURFACTANT MIXTURES

[75] Inventors: Ammanuel Mehreteab, Piscataway, N.J.; Frank Loprest, Langhorn, Pa.

[73] Assignee: Colgate Palmolive Co., Piscataway, N.J.

[ * ] Notice: The portion of the term of this patent subsequent to Aug. 15, 2012, has been disclaimed.

[21] Appl. No.: 103,948

[22] Filed: Aug. 10, 1993

Related U.S. Application Data

[63] Continuation of Ser. No. 829,120, Jan. 31, 1992, which is a continuation of Ser. No. 382,137, Jul. 19, 1989, abandoned.

[51] Int. Cl.[6] ..... C11D 3/36; C11D 1/62

[52] U.S. Cl. ..... 8/137; 252/174.16; 252/547; 252/558

[58] Field of Search ..... 8/137; 252/174.16, 252/547, 558

[56] References Cited

U.S. PATENT DOCUMENTS

| | | | |
|---|---|---|---|
| 4,058,489 | 11/1977 | Hellsten | 252/547 |
| 4,264,457 | 4/1981 | Beeks et al. | 252/8.75 |
| 4,333,862 | 6/1982 | Smith et al. | 252/547 |
| 4,338,204 | 7/1982 | Spadini et al. | 252/547 |

*Primary Examiner*—Jerry D. Johnson
*Attorney, Agent, or Firm*—Richard E. Nanfeldt; Robert C. Sullivan; Murray Grill

[57] ABSTRACT

Complexes of anionic and cationic surfactants have been found to remove oily stains from fabrics remarkably better than either the cationic or anionic surfactant from which they are formed.

3 Claims, 26 Drawing Sheets

SURFACE TENSION VS. SURFACTANT CONC. FOR (O) TTAB; (□) AEOS; (Δ) 1;1 AEOS/TTAB, SURFACTANT CONC. = [AEOS] + [TTAB]; (*) 1:1 AEOS/TTAB, SURF. CONC. = ([AEOS] + [TTAB]/2 = [COMPLEX].

CLOUD POINT TEMP. OF APE/TTAB SOLUTION
(o) ACIDIC APE, pH=2.2; (□) APE + NaOH, pH=2.8;
(△) APE + NaOH AT FIRST EQUIVALENT POINT, pH=4.87;
(*) APE + NaOH, pH=6.0.

CLOUD POINT TEMP. OF AEOS/TTAB SOLUTION
(TOTOAL SURFACTANT CONCENTRATION = 0.05 M).

CLOUD POINT TEMP. VS TOTAL SURFACTANT CONCENTRATION OF AEOS/TTAE SOLUTION AT AEOS MOLE FRACTION OF (●) 0.48; (□) 0.49; (△) 0.50; (*) 0.51.

CLOUD POINT TEMP. VS TOTAL SURFACTANT CONCENTRATION OF AEOS/TTAB SOLUTION AT AEOS MOLE FRACTION OF (o) 0.45; (□) 0.46; (*) 0.47.

C14TAB/AEOS
C12TAB/AEOS
EQ18-15/SOAP
EQ18-20/SOAP
EQ18-25/SOAP
EQC-25/SOAP

ANIONIC/CATIONIC SURFACTANT MIXTURES

This application is a continuation of application Ser. No. 07/829,120, filed Jan. 31, 1992, which is a continuation of Ser. No. 382,137, now abandoned.

BACKGROUND OF THE INVENTION

1. Field of the Invention

The present invention relates to anionic/cationic surfactant mixtures. More particularly, the present invention relates to the use of water-soluble complexes of anionic and cationic surfactants as superior oily soil removal agents.

2. Description of the Prior Art

In principle any surfactant can be used in detergency. In practice, however, only anionic and nonionic surfactants are used. Cationic surfactants (specifically the quaternary ammonium salts) when used in heavy duty liquid detergents, decrease detergency and enhance soil redeposition. Consequently, there is a general notion that anionic and cationic surfactants cannot be used in the same formula without loss of efficacy. On the other hand, cationic surfactants are one of the most important class of compounds used as antistat and softening agents in rinse cycle products. And recently, they have been used in heavy duty laundry detergent-softener products. Softening is achieved in such products but unfortunately at the expense of cleaning efficacy. Cationic surfactants are also the main ingredients in hair conditioners. Unfortunately, here also there is a problem attributed to the presence of quat. A residue build-up accumulates on the hair due to extended use of conditioners. Consumers are believed to be aware of the problem and try to overcome it by changing shampoos occasionally.

Numerous attempts to overcome the aforementioned problems have been tried. Illustrative of these attempts are:

U.S. Pat. No. 3,703,480, to Grant et al., discloses a washing cycle fabric softener consisting essentially of a cationic quaternary ammonium fabric softener and an amino polyureylene resin. In particular, it is noted that quaternary ammonium softener compounds are positively charged and deposit readily on a negatively charged surface of textiles to form a lubricous surface on the textile which feels soft to the touch. However, it is also noted that a large percentage of the common laundry detergents contain anionic surface active agents which tend to inactivate or neutralize cationic softening agents. The inclusion of the amino polyureylene resin in combination with the quaternary ammonium softener compounds is taught to substantially reduce this problem of incompatibility of anionics and cationics.

U.S. Pat. No. 3,730,912, to Inamorato, discloses a ternary foam control system comprising a synergistic mixture of a fatty acid, polyethoxylated quaternary ammonium salt and a high molecular weight amide or a primary, secondary or tertiary amine. The ternary foam control system may be used in conjunction with conventional useful detergents including anionic detergents such as alkyl-benzene sulfonic acid and its salts, alkali metal dialkyl sulfosuccinates, alkali metal alkyl sulfates, sodium diisopropylnaphthalenesulfonate, sodium octylphenoxyethoxyethylsulfonate, etc. The ternary foam control system broadly comprises about 20 to 80 percent fatty acid, about 10 to 60 percent polyethoxylated quaternary ammonium salt and about 10 to 60 percent amide or amine. In a total detergent system, there is employed broadly about 1 to 6 percent fatty acid, about 1 to 6 percent polyethoxylated quaternary ammonium salt and about 1 to 6 percent amide or amine, in conjunction with about 8 to 18 percent of anionic detergent.

U.S. Pat. No. 3,997,453, to Wixon, discloses stable, fabric softening compositions having improved dispersibility in cold water which comprise a cationic quaternary ammonium softener as the sole fabric softening agent and an organic, anionic sulfonate. The weight ratio of the cationic softener to the anionic sulfonate may be from about 80:1 to 3:1. The compositions typically comprise 0.4 to 5% of the anionic sulfonate detergent and from about 6 to about 25% of the cationic softener material, with the balance being primarily water. The amount of organic anionic sulfonate additive is insufficient to cause significant loss of softening performance due to cationic-anionic interaction.

U.S. Pat. No. 4,000,077, to Wixon, discloses a softening composition which imparts a superior degree of softness and whiteness to textiles and which contains, as the essential ingredients, a cationic quaternary softener, preferably an imidazolinium salt, and a minor amount of a higher aliphatic alcohol sulfate. The weight ratio of the cationic quaternary softener to the higher alcohol sulfate may be from 10:1 to 2:1. The softening composition may be prepared, and used, in liquid or solid form, adsorbed onto a carrier. The amount of the cationic quaternary softener present in the liquid composition may be within the range of 2–20%. The liquid composition may be sprayed on, or otherwise agglomerated with, particles of borax, sodium carbonate, sodium bicarbonate, sodium sesquicarbonate, sodium sulfate, sodium chloride, phosphate salts, or other carrier materials to form granular or powdered compositions. These solid compositions may contain the cationic quaternary softener in an amount within the range of 2–30%.

U.S. Pat. No. 4,298,480, to Wixon, discloses heavy-duty detergent compositions, for imparting improved softness and detersive effects to fabrics laundered therewith, which compositions include, in addition to conventional builder and principally anionic surfactant components, fatty acid soap and cationic softener of the di-lower-di-higher alkyl quaternary ammonium and/or heterocyclic imide type, e.g., imidazolinium. The weight ratio of soap to softener is about 8:1 to 1:3, preferably about unity. The soap, in the form of a spaghetti, flake or other shape, is present in the product composition as substantially homogeneously dispersed, discrete particles.

U.S. Pat. No. 4,329,237, to Wixon, discloses heavy-duty detergent compositions, for imparting improved softness and detersive effects of fabrics laundered therewith, which compositions include, in addition to conventional builder and principally anionic surfactant components, cationic softener of the all-lower-all-higher alkyl quaternary ammonium-and/or heterocyclic imide-type and a mixture of fatty acid soap and nonionic organic surfactant. The weight ratio of soap to softener is about 8:1 to 1:3, preferably about unity. The soap/nonionic surfactant mixture, in the form of a spaghetti, flake or other shape, is present in the product composition as substantially homogeneously dispersed discrete particles.

U.S. Pat. No. 4,411,803, to Wixon, discloses heavy-duty detergent compositions, for imparting improved softness and detersive effects to fabrics laundered therewith, which compositions include, in addition to conventional builder and principally anionic surfactant components, cationic softeners of the di-lower-di-higher alkyl quaternary ammonium-and/or heterocyclic imide-type and a mixture of fatty acid soap and nonionic organic surfactant. The weight ratio of soap to softener is about 8:1 to 1:3, preferably about unity.

The soap/nonionic surfactant, in the form of a spaghetti, flake or other shape, is present in the product composition as substantially homogeneously dispersed, discrete particles.

U.S. Pat. No. 4,450,085, to Wixon, discloses heavy-duty detergent compositions, for imparting improved softness and detersive effects to fabrics laundered therewith, which compositions include, in addition to conventional builder and principally anionic surfactant components, cationic softeners of the di-lower-di-higher alkyl quaternary ammonium- and/or heterocyclic imide-type and a mixture of fatty acid soap, nonionic organic surfactant and magnesium sulfate. The weight ratio of soap to softener is about 8:1 to 1:3, preferably about unity. The soap/nonionic surfactant/magnesium sulfate mixture, in the form of a spaghetti, flake or other shape, is present in the product composition as substantially homogeneously dispersed, discrete particles.

U.S. Pat. No. 3,869,412, to Waag, discloses surface-active compositions having controlled foaming properties comprising an anionic sulphonate or sulphate ester surfactant; a nonionic polyoxyalkylene ether, ester or glycol surfactant; and an anionic polyoxyalkylene phosphate ester surfactant. The polyoxyalkylene phosphate ester and the polyoxyalkylene ether, ester or glycol surfactants serve as low-foaming components, and the anionic sulphonate or sulphate ester surfactant increases the foaming properties of the mixtures in proportion to the amount present.

U.S. Pat. No. 3,956,198, to Bauer, discloses a washing-aid composition, suitable for the removal of stains and soil from delicate fabrics which are deleteriously affected by alkaline conditions, comprising: a phosphate ester surfactant; an alkali metal salt of an aminopolyacetic acid in an amount sufficient to essentially neutralize the surfactant to a pH of about 7; a water-miscible organic solvent in an amount sufficient to solubilize organic borne stains and dirt; and water in an amount sufficient to solubilize the aminopolyacetic acid salt.

U.S. Pat. No. 4,116,885, to Derstadt, discloses detergent compositions, which are particularly effective in removing oily soils from hydrophobic fibers, comprising specific anionic surface-active agents, polyester soil-release polymers, and limited amounts of incompatible anionic surface-active agents. Co-surfactants such as sulfobetaines and nonionics may also be included in the compositions.

U.S. Pat. No. 4,132,680, to Nicol, discloses detergent compositions which are particularly suitable for providing hydrophobic fabrics, such as polyester, with a soil release effect for oily soils. The compositions contain surface-active agents (anionic, nonionic, ampholytic, zwitterionic and mixtures thereof), polyester soil-release polymers and a component which dissociates in aqueous solution to produce quaternary ammonium cations.

U.S. Pat. No. 4,137,190, to Chakrabarti et al., discloses a detergent composition comprising a low-foaming, non-ionic surfactant and a synergistic hydrotrope mixture. The hydrotrope mixture is composed of two classes of organic phosphate esters, the first class is a reaction product of a compound of the formula (i)

$$R(OCH_2CH_2)_n\ OH, \qquad (i)$$

wherein R is alkyl, aryl, aralkyl, or alkaryl and n is 1 to 10, with phosphorous pentoxide, and the second class is a reaction product of a compound of the aforementioned formula (i) with polyphosphoric acid. The weight ratio of the first class to the second class is 1:9 to 9:1.

U.S. Pat. No. 4,247,424, to Kuzel et al., discloses stable liquid detergent compositions which contain an ethoxylated alcohol or ethoxylated alkylphenol nonionic surfactant, an amine oxide surfactant, a water-soluble detergency builder, a hydrophobic emulsifier and water.

U.S. Pat. No. 4,264,457, to Beeks et al., discloses a cationic liguid laundry detergent for softening fabrics and giving them antistatic properties. The detergent contains: about 3–35 weight % nonionic surfactant formed by reacting 5–200 moles of ethylene oxide with a hydrophobic organic compound having 8–50 carbon atoms; about 3–30 weight % mono-long-chain cationic surfactant; and water-soluble anionic surfactants selected from a mixture of $C_{4-10}$ alcohol sulfates and $C_{12-22}$ alcohol ethoxylated ether sulfates or carboxylate. The anionic surfactants are present at a mole ratio of about 1:5 to 5:1. The mole ratio of cationic surfactant to anionic surfactant is about 0.8:1 to 10:1.

U.S. Pat. No. 4,348,305, to Henneman et al., discloses a stable, liquid detergent with fabric softening action for simultaneously washing and softening delicate fabrics. The detergent composition comprises: (a) from about 5 to 18 weight of a mixture of alkyl polyglycol ethers of the formula

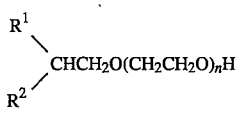

wherein $R^1$ represents a linear alkyl radical, $R^2$, in from about 20 to 75% of said alkyl polyglycol ethers, represents a $C_{1-4}$ alkyl group and, in from about 25 to 80% of said alkyl polyglycol ethers, represents a hydrogen atom, the total number of carbon atoms in $R^1$ and $R^2$ together being from about 11 to 15, and n represents an average value of from about 5 to 9; (b) from about 5 to 18 weight % of a mixture of alkyl polyglycol ethers of the formula

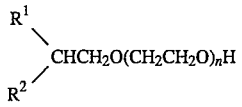

wherein $R^1$ represents a linear alkyl group, $R^2$ is a hydrogen atom or, in from about 20 to 75% of said alkyl polyglycol ethers, represents a $C_{1-4}$ alkyl group and, in from about 25 to 80% of said alkyl polyglycol ethers, represents a hydrogen atom, the total number of carbon atoms in $R^1$ and $R^2$ together being from about 6 to 10, and n represents an average value of from about 3 to 8; and (c) from about 2.5 to 10 weight % of a fabric-softening quaternary ammonium salt. The quantitative ratio of components (a) and (b) is from about 2:1 to 1:2.

U.S. Pat. No. 4,369,134, to Deguchi, discloses a creamy cleansing composition comprising:

(A) from 10 to 60 weight % of one or more phosphoric ester surfactants represented by the formulae

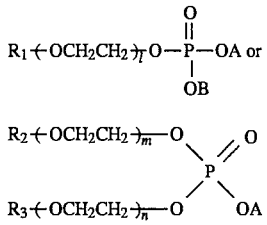

where each of $R_1$, $R_2$ and $R_3$ represents a saturated or unsaturated hydrocarbon group having from 8 to 18 carbon atoms, each A and B represents a hydrogen atom, an alkali metal, ammonium or an alkanol amine having 2–3 carbon atoms, and each of 1, m and n is 0 or an integer of from 1 to 10, (B) from 0.5 to 15 weight % of an organic or inorganic salt, (C) from 0.5 to 15 weight % of polyethylene glycol having a molecular weight of from 4,000 to 10,000, and (D) a surface active agent selected from the group consisting of (1) from 0.1 to 15 weight % of an ethylene oxide addition type non-ionic surface active agent, (2) from 0.05 to 10 weight % of a cationic surface active agent represented by the formula

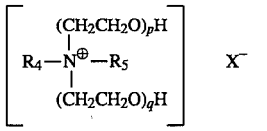

where $R_4$ represents a saturated or unsaturated hydrocarbon group having 8 to 18 carbon atoms, $R_5$ represents a methyl group or an ethyl group, X represents a halogen atom, and each of p and q represents an integer of from 1 to 15, and (3) from 0.05 to 10 weight % of a cationic surface active agent represented by the general formula

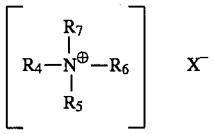

where $R_6$ represents a methyl group or an ethyl group, $R_7$ represents a saturated or unsaturated hydrocarbon group having from 8 to 18 carbon atoms, and $R_4$, $R_5$ and X are as defined above.

U.S. Pat. No. 4,436,653, to Jacobson et al., discloses stable liquid detergent compositions containing nonionic, amine oxide and alcohol polyethoxylate sulfate surfactants and a water-soluble detergency builder. The compositions are single phase isotropic liquids which exhibit improved freeze-thaw stability. The polyethoxylate sulfate surfactant enhances detergency performance on textiles that have been softened with a conventional cationic fabric softener.

U.S. Pat. No. 4,493,782, to Williamson, discloses cleansing compositions comprising 90–95 weight % of monoesters of phosphoric acid having the formula

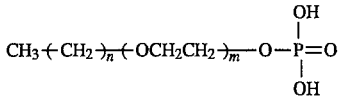

wherein n has a value from about 7 to 11 and m has a value from about 2 to 4; and 2–3 weight % of a stabilizer having the formula

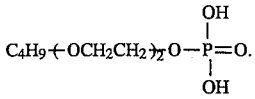

U.S. Pat. No. 4,715,990, to Crossin, discloses a soil-release promoting, enzyme-containing nonionic detergent, in the form of a transparent or translucent liquid, comprising: a synthetic organic nonionic detergent; a higher fatty alcohol polyethoxylate sulfate; a soil-release promoting polymer of polyethylene terephthalate and polyoxyethylene terephthalate; a proteinaceous and/or amylaceous soil enzymatically hydrolyzing effective amount of enzyme(s); an enzyme stabilizer; and an aqueous medium.

U.S. Pat. No. 3,892,669, to Rapisarda et al., discloses a clear, homogeneous, aqueous fabric-softening composition comprising a solubilized tetralkyl quaternary ammonium salt having two short-chain alkyl groups and two long-chain alkyl groups. The solubilizers comprise aryl sulfonates, diols, ethers, low molecular weight quaternaries, sulfobetaines, alkyl taurines, amines, phosphines, sulfoxides and nonionic surfactants.

U.S. Pat. No. 4,058,489, to Hellsten, discloses a detergent composition having good cleaning effectiveness while simultaneously imparting a soft feel and/or a good conductivity for static electricity to the material treated therewith. The composition comprises a mixture of surfactants of which: (a) from 30 to 90% by weight is a surfactant selected from the group consisting of nonionic surfactants, amphoteric surfactants and mixtures thereof; and (b) from 10 to 70% by weight is a surfactant mixture comprising at least one anionic surfactant and at least one cationic surfactant in a charge ratio (anionic surfactant:cationic surfactant) within the range from about 0.60 to about 0.90.

U.S. Pat. No. 4,118,327, to Seugnet, discloses fabric softener/anti-static compositions wherein phosphoric acid esters, which are anionic anti-static agents, are incorporated into conventional cationic fabric softeners for addition to the rinse cycle of automatic home laundry machines or for the final rinse in an industrial fabric treating process.

U.S. Pat. No. 4,222,905, to Cockrell, Jr., discloses a laundry detergent composition containing no or low levels of phosphate materials. The compositions are unusually effective in removing particulate soils from fabrics. The compositions comprise from about 5 to about 100% by weight of a surfactant mixture consisting essentially of (a) a biodegradable nonionic having the formula $$R(OC_2H_4)_n\ OH$$

wherein R is a primary or secondary alkyl chain of from about 8 to 22 carbon atoms and n is an average of from about 2 to about 12; and (b) a cationic surfactant, free of hydrazinium groups.

U.S. Pat. No. 4,292,035, to Battrell, discloses fabric softening compositions comprising a combination of an anionic surfactant and a complex of certain smectite clays with certain organic amines and certain quaternary compounds.

U.S. Pat. No. 4,333,862, to Smith et al., discloses a liquid detergent composition comprising from 2 to 100% of a surfactant system consisting essentially of a water-soluble or water-dispersible combination of (a) from 15 to 45% of an anionic surfactant; (b) a water-soluble quaternary ammonium cationic surfactant, in a ratio of anionic:cationic of less than 5:1; and (c) a nonionic surfactant having the formula $RO(C_2H_4O)_nH$ wherein R is a primary or secondary, branched or unbranched $C_{8-24}$ alkyl or alkenyl or $C_{6-12}$ alkyl phenyl, and n, the average degree of ethoxylation, is from 2 to 9, wherein the ratio of nonionic:cationic surfactant is from 5:1 to 2:3.

U.S. Pat. No. 4,338,204, to Spadini et al., discloses a laundry detergent composition providing cleaning and softening of textiles. The composition comprises: an anionic surfactant; a water-insoluble di-$C_{10-26}$ tertiary amine; and a water-soluble cationic compound which may be a mono $C_{10-18}$ alkyl, primary, secondary or tertiary amine, or a water-soluble salt thereof or a water-soluble mono $C_{8-16}$ alkyl quaternary ammonium compound.

U.S. Pat. No. 4,632,530, to Gross et al., discloses dyeing auxiliaries comprising (A) 10 parts by weight of an anionic product obtained by addition of 5 to 20 mols of ethylene oxide to an aliphatic saturated or unsaturated alcohol of 10 to 24 carbon atoms, followed by carboxymethylation; (B) 1 to 15 parts by weight of a cationic addition product of 50 to 150 mols of ethylene oxide to a fatty amino-$C_{2-3}$-alkylene-amine; (C) 1 to 10 parts by weight of a nonionic addition product of 20 to 150 mols of ethylene oxide to castor oil, or a non ionic sequenced addition product of 20 to 150 mols of ethylene oxide and 1 to 10 mols of propylene oxide to castor oil; and (D) 1 to 20 parts by weight of a N-(β-hydroxy-$C_{2-4}$-alkyl)-fatty acid amide.

U.S. Published patent application Ser. No. B 310,740, to Barrat, discloses a detergent composition containing enzymes consisting essentially of: (a) from 0.001% to about 5% by weight of a proteolytic enzyme having an iso-electric point greater than 9.5 selected from the group consisting of the enzymes produced by *Bacillus alcalophilus* NCIB 8772 and bacterium strain NCIB 10147; (b) from about 20% to about 80% by weight of a cationic surfactant; and (c) from about 80% to about 20% by weight of an anionic surfactant.

Canadian Patent 818,419, to Urfer et al., discloses a textile softener/detergent composition comprising: a cationic-anionic electro-neutral complex; and a quantity of a cationic-nonionic dispersing mixture sufficient to effectively disperse the electro-neutral complex in an aqueous medium, and to effectively maintain tile dispersion in an environment which will inhibit interfering anionic materials from altering the composition's capability for simultaneously washing and softening textiles.

Additionally, there have been many studies and symposia (e.g., Scamehorn, J. F., ed., "Phenomena in Mixed Surfactant Systems", ACS Symposium Series 311, Washington, D.C. (1986)) on mixed surfactant systems. The effect of alkyl groups and oxyethylene groups in nonionic surfactants on the surface tension of anionic-nonionic systems have been described (Abe et al., J. Colloid Interface Sci., 107, p. 503 (1985); Ogino et al., J. Colloid Interface Sci., 107, p. 509 (1985); and Rosen et al., J. Colloid Interface Sci., 95, 443 (1983)). Interaction between betaines and cationic surfactants (surface tension vs. concentration) has also been studied (Zhu et al., J. Colloid Interface Sci., 108, 423 (1985)).

Mixed surfactant systems have shown synergistic effects relative to the properties of their individual surfactant components. Synergism increased with the degree of charge difference. Synergism between anionic and anionic or nonionic and nonionic is less than anionic and nonionic or cationic and nonionic which in turn are much less than those of anionic and cationic mixtures (Rosen et al. in "Phenomena in Mixed Surfactant Systems" (Scamehorn, J. F., ed.), ACS Symposium Series 311, Washington, D.C. (1986), pp. 144–162; and Zhao et al. in "Phenomena in Mixed Surfactant Systems" (Scamehorn, J. F., ed.) ACS Symposium Series 311, Washington, D.C. (1986) pp. 184–198).

Studies on anionic/cationic systems are recent and few compared to studies on other mixed surfactant systems. However, strong synergism has been exhibited by these systems. Surface activity, particularly the critical micelle concentration (cmc), surface tension, and microemulsion behavior (Bourrel et al., Tenside Detergents, 21, 311 (1984)), were the most studied properties. For example, the surface activities of mixed aqueous solutions of sodium dihexylsulfosuccinate with dioctyl(hydroxyethyl)methylammonium chloride and sodium dihexylsulfosuccinate with octyl(hydroxyethyl)dimethylammonium chloride were much higher than those of the single surfactants (Zao, G., Huoxue Xuebo, 43, 705 (1985) (Ch. Chem. Abstracts 103:184033n)). The strong synergistic effect on surface pressure for mixed solutions of cationic and anionic surfactants has been studied quantitatively. When dilute solutions of sodium dodecylsulfate and dodecyltrimethylammonium bromide were mixed, tile surface pressure increased by more than 40 mN/m. Also, the cmc and the minimum surface tension were lower for the mixture than for either the anionic or cationic surfactants alone (Lucassen-Reynders et al., J. Colloid Interface Sci., 81, p. 150 (1981)).

Mixed anionic/cationic systems have shown not only synergistic but also antagonistic effects relative to the properties of the individual surfactant components (Chobanu et al., Izv. Akad. Nauk. Mold. SSR, Ser. Biol. Khim. Nauk., 5, p. 66 (1982)). Unlike the other mixed surfactant systems, most anionic/cationic surfactant mixtures studied are insoluble or only slightly soluble. Therefore, their practical use, in areas where high concentration of surfactants are needed, is very limited.

SUMMARY OF THE INVENTION

Accordingly, it is one object of the present invention to provide water-soluble complexes of anionic/cationic surfactant mixtures.

It is a further object of the present invention to provide a superior method for removing oily soils by use of such water-soluble complexes of anionic/cationic surfactant mixtures.

These and other objects of the invention, as will become apparent hereinafter, have been achieved by the provision of a method for removing oily soils from fabrics comprising contacting said fabrics containing oily soils with an aqueous solution of a detersively effective amount of a water-soluble mixture of at least one anionic surfactant and at least one cationic surfactant.

In a preferred embodiment of the method, the at least one cationic surfactant is of the formula (I)

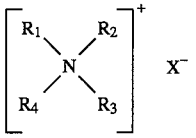

(I)

wherein $R_1$ is an alkyl or alkenyl radical containing from about 8 to about 22 carbon atoms, $R_2$ is an alkyl group of not more than 6 carbon atoms, $R_3$ and $R_4$, which may be the same or different, are selected from the group consisting of alkyl of not more than 6 carbon atoms and $-(R_5O)_nH$, wherein $R_5$ is an alkylene of 2 to 4 carbon atoms and n is a number of from 1 to 25, and $X^-$ is a water-soluble anion.

The at least one anionic surfactant may be of the sulfate, sulfonate, phosphate or carboxylate type. Preferred anionic surfactants are anionic sulfate and sulfonate compounds of the formula (II)

$$R_6—SO_3M \quad (II)$$

wherein $R_6$ represents a hydrocarbon group of from about 8 to about 22 carbon atoms which may be linked to the sulfonate group via alkoxy or via oxyalkoxy, for example, $R_6$ is selected from the group consisting of

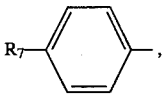

$R_8$, $R_9-(OR_5)_m$ and $R_9—O-(R_5O)_{m'}$; wherein $R_7$ is an alkyl radical of from 8 to about 18 carbon atoms, $R_8$ is a straight chain or branched, saturated or unsaturated aliphatic radical of from about 8 to about 22 carbon atoms, $R_9$ is a hydrocarbon radical of from about 8 to about 22 carbon atoms, $R_5$ is an alkylene of 2 to 4 carbon atoms, m is a number of from 1 to 25, and m' is a number of from 0 to 25, M is a water-soluble cation;

anionic phosphate esters of the formula (III)

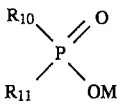

(III)

wherein $R_{10}$ is $R_{12}—O-(R_5O)_o$, $R_{11}$ is $R_{12}—O-(R_5O)_o$ or —OM, $R_5$ is an alkylene of 2 to 4 carbon atoms, o is a number of 1 to 25, $R_{12}$ is a hydrocarbon radical of from about 8 to about 22 carbon atoms, and M is a water-soluble cation;

carboxylate salts of the formula (IV)

$$R_{13}COOM \quad (IV)$$

wherein $R_{13}$ is $R_{14}$ or $R_{14}—O-(R_5O)_pCH_2—$ wherein $R_{14}$ is a hydrocarbon radical of from about 7 to about 21 carbon atoms, $R_5$ is an alkylene of 2 to 4 carbon atoms, p is a number of 1 to 25 and M is a water-soluble cation.

BRIEF DESCRIPTION OF THE DRAWING FIGURES

Figure 20:
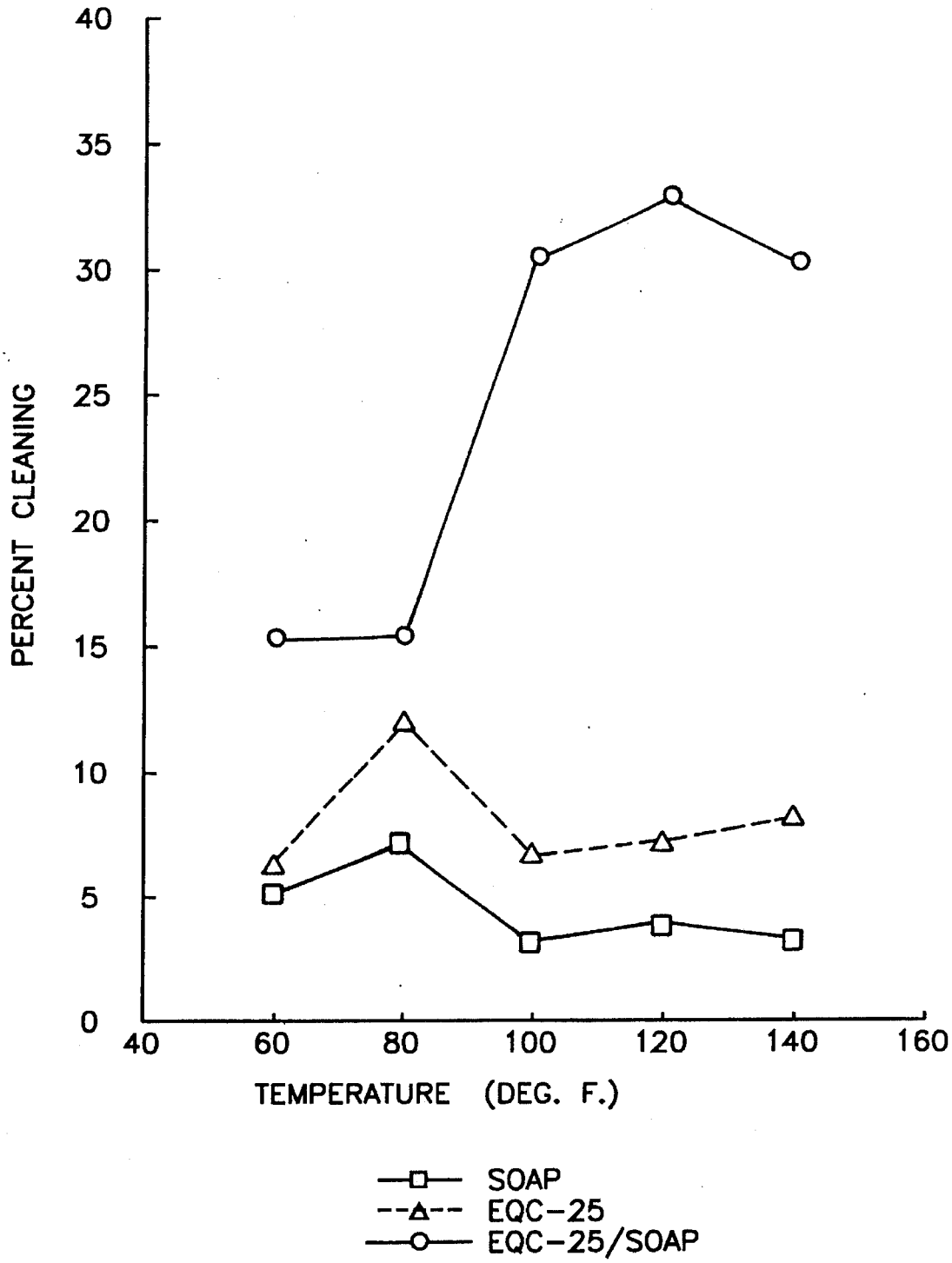

FIG. 20 is a graph of Crisco detergency vs. washing temperature for various anionic and cationic surfactants and mixtures thereof.

Figure 21:
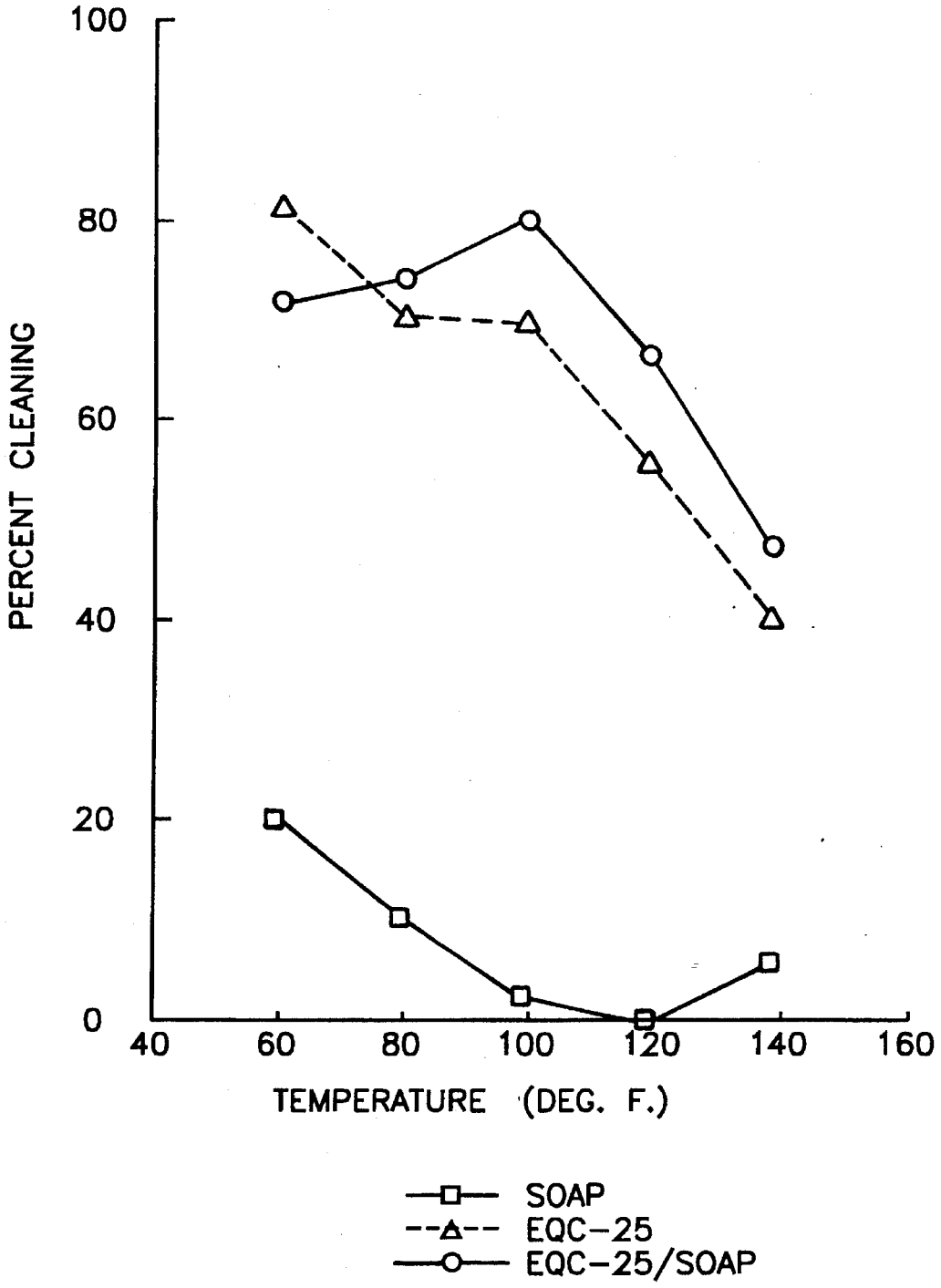

FIG. 21 is a graph of sebum detergency vs. washing temperature for various anionic and cationic surfactants and mixtures thereof.

Figure 22:
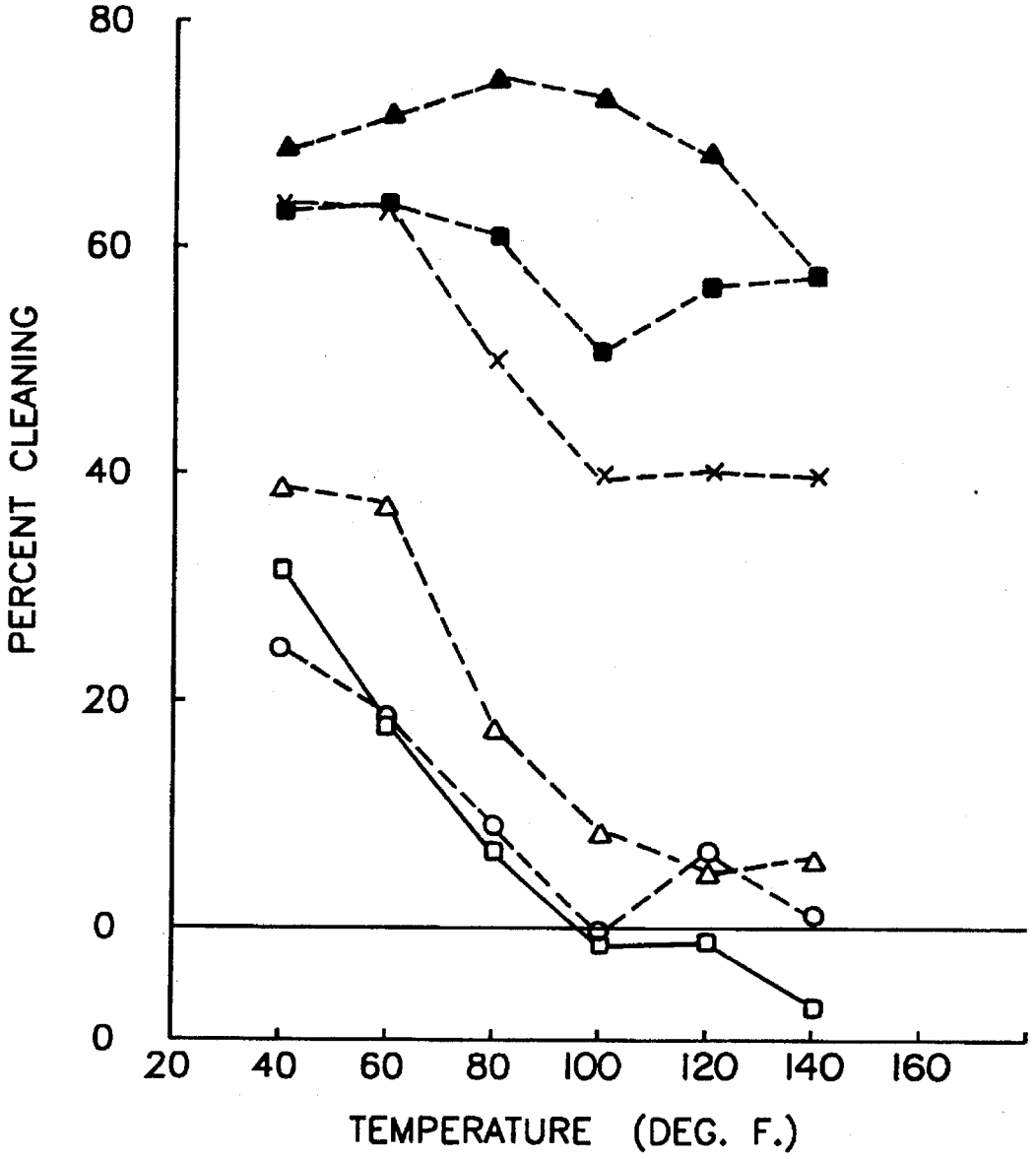

FIG. 22 is a graph of sebum detergency vs. washing temperature for various anionic/cationic mixtures.

Figure 23:
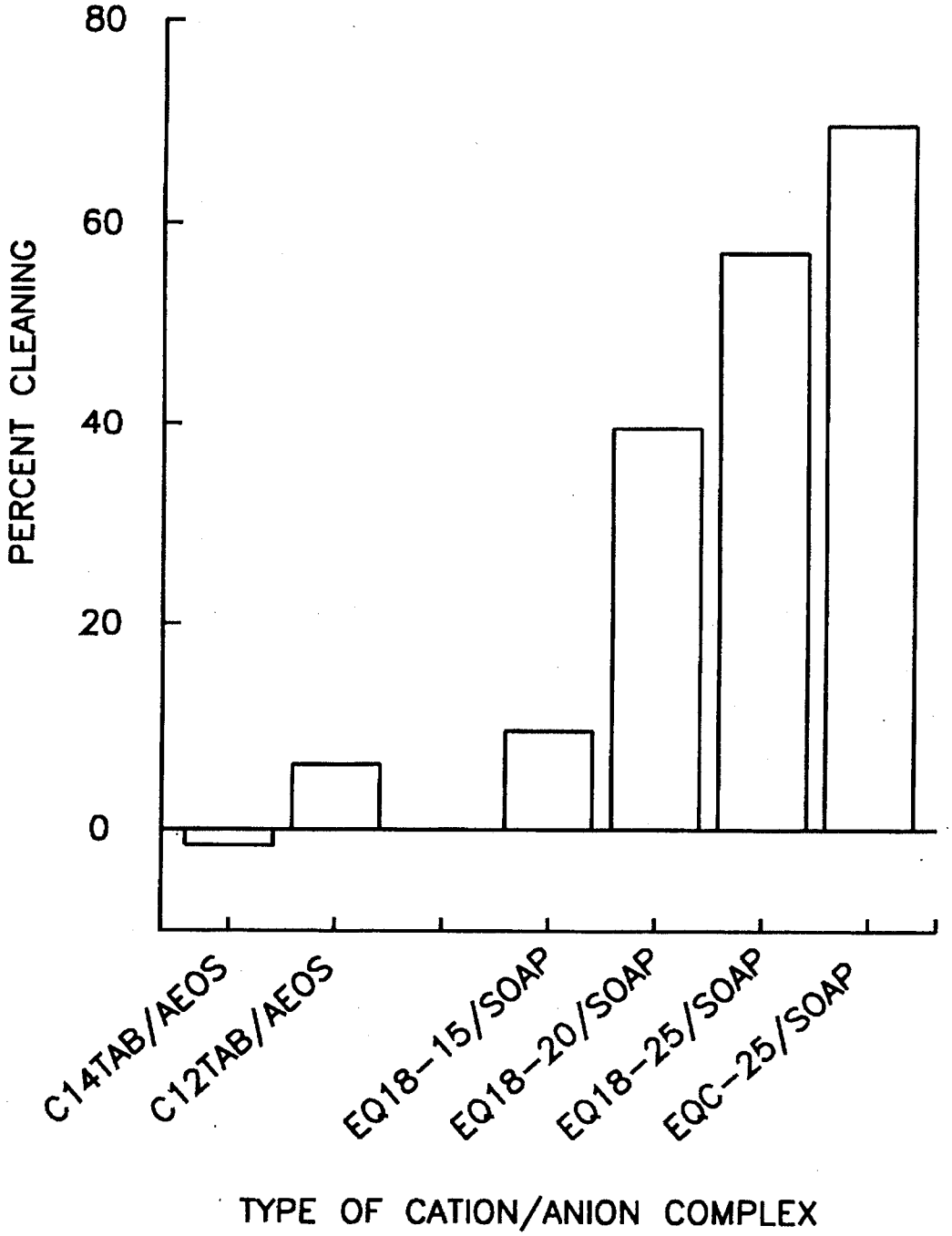

FIG. 23 is a bar graph of sebum detergency for various anionic/cationic mixtures.

Figure 24:
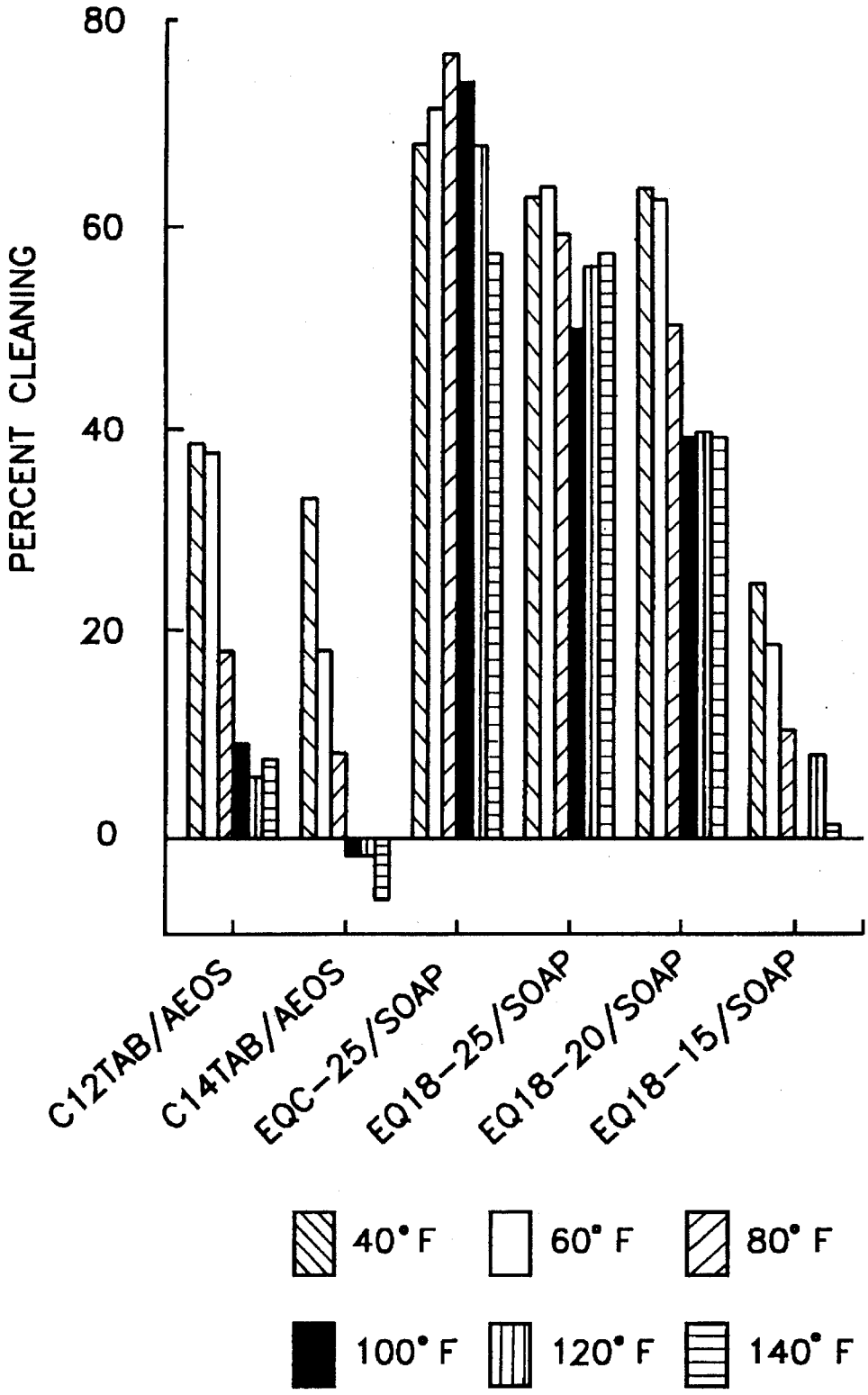

FIG. 24 is a bar graph of sebum detergency for various anionic/cationic mixtures at various temperatures.

Figure 25:
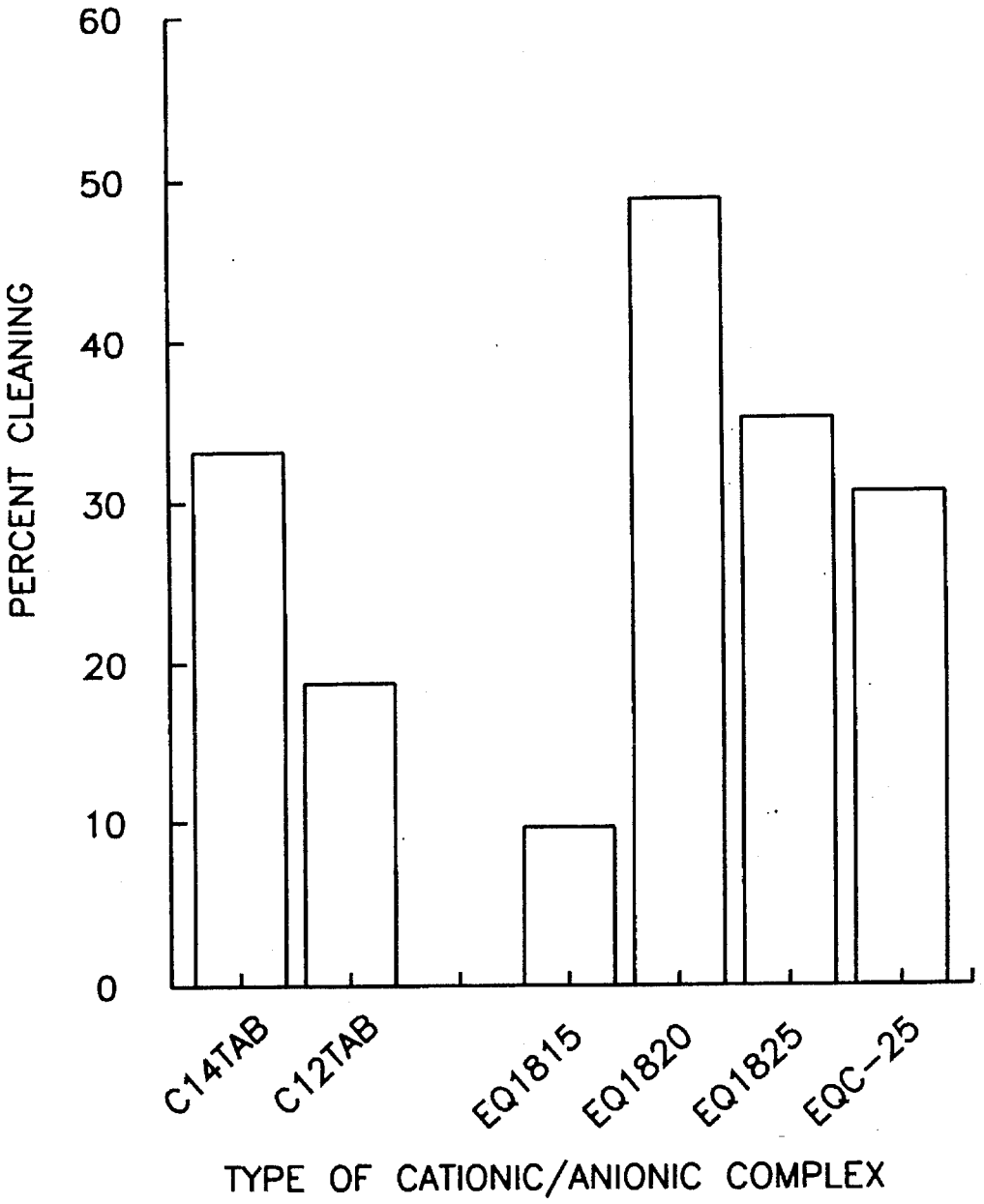

FIG. 25 is a bar graph of Crisco detergency for various anionic/cationic mixtures.

Figure 26:
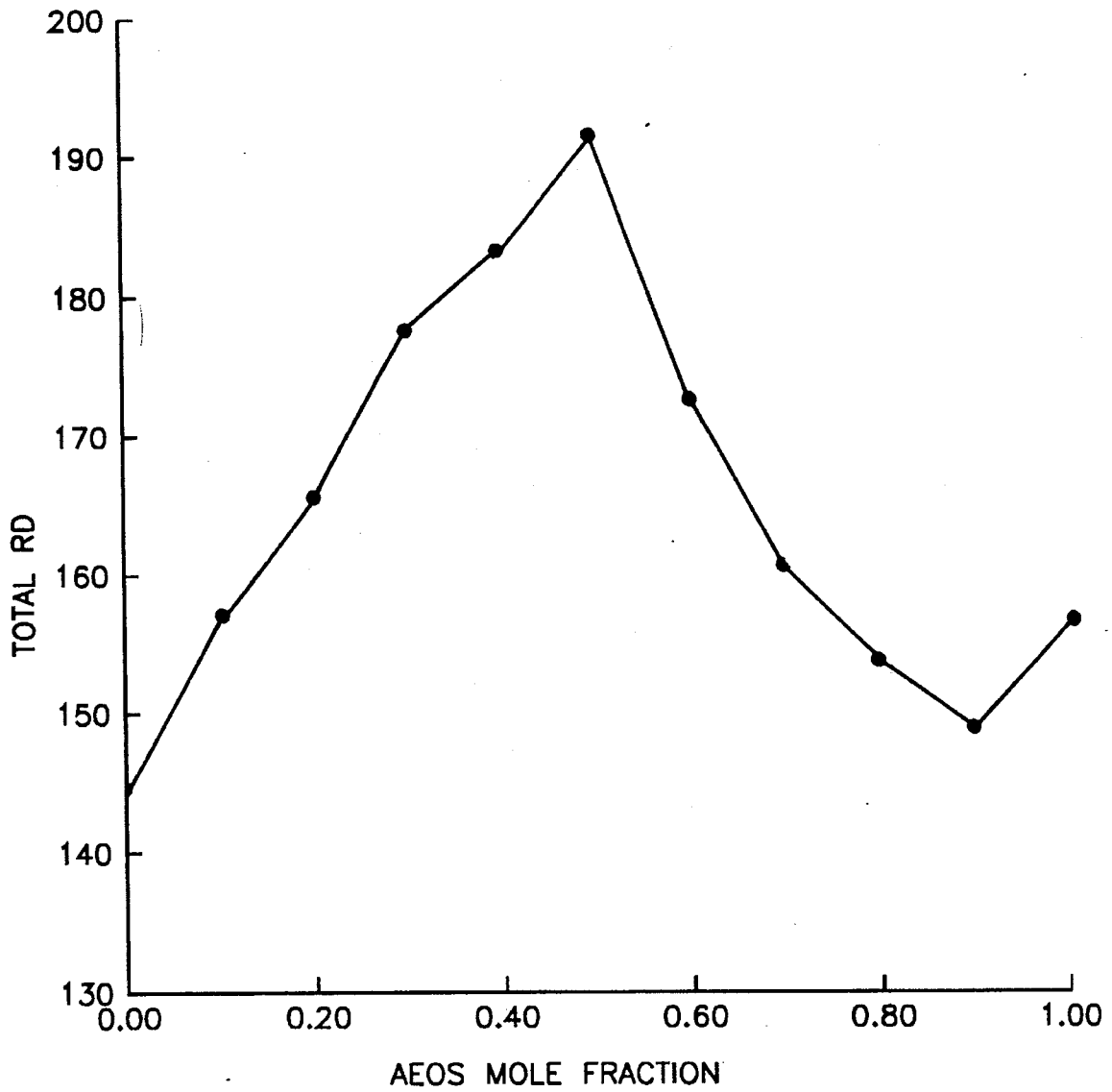

FIG. 26 is a graph of total cleaning efficiency (Rd) for three types of oily soils: French dressing, barbecue sauce and Crisco, for various anionic/cationic mole ratios.

DETAILED DESCRIPTION OF THE INVENTION

Cationic and anionic surfactants form complexes which are generally insoluble because the charged heads (anionic or cationic) which are responsible for water solubility are neutralized during complexation. We lave found that if either the cationic surfactant or anionic surfactant contains additional hydrophilic groups (such as ethylene oxide groups or additional charge that remains unneutralized during complexation) then a water soluble complex may be formed. Water solubility is assured if the hydrophilic group is large enough, i.e. that the idea of HLB (hydrophilic lipophilic balance) is applicable to the complex as a whole.

We have proved that even in clear solutions of cationic and anionic surfactants, complexes are formed. For example when a neutral aqueous solution of cationic surfactant is added to an aqueous solution of an acidic anionic surfactant, the pH of the acidic solution decreases with a minimum occurring at 1:1 mole ratio of the two surfactants. More proof that a soluble complex has formed is indicated by the unique behavior of the complex which is different than its anionic and cationic surfactant component in its interfacial tension behavior and its detergency behavior. The interfacial tension between some oils and an aqueous solution of the complex was found to be lower than between the same oils and the aqueous solution of the individual anionic and cationic surfactants. Another proof of soluble complex formation is that the solution of the complex exhibited cloud point phenomena, while the solution of each surfactant component did not. In addition, the complex removed oily soils from fabric better than its surfactant components. We prepared complexes that behave as organic solvents and surfactants in their ability to interact with oily soils and lower the interfacial tension between water and oil. Soluble complexes are formed when either or both of the cationic and anionic surfactants contain functional groups with minimum amount of hydrophilicity that remain unaffected (undiminished) during complexation. Surfactants with a minimum number of ethylene oxide groups or additional charges that remain unneutralized during complexation, will form soluble complexes.

Suitable cationic surfactants include those of the formula (I)

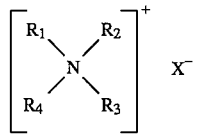

(I)

wherein $R_1$ is an alkyl or alkenyl radical containing from about 8 to about 22 carbon atoms, preferably from about 12 to about 22 carbon atoms, $R_2$ is an alkyl group of not more than 6 carbon atoms, preferably from about 1 to 4 carbon atoms, $R_3$ and $R_4$, which may be the same or different, are selected from the group consisting of alkyl of not more than 6 carbon atoms, preferably from 1 to 4 carbon atoms, and $-(R_5O)_n$ H, wherein $R_5$ is an alkylene of 2 to 4 carbon atoms, preferably 2 or 3, especially preferably 2 carbon atoms, and n is an integer of from 1 to 25, preferably 2 to 20, and $X^-$ is a water-soluble salt-forming anion. Preferably $R_1$ is an alkyl or alkenyl of 14 to 20 carbon atoms, especially 14 to 18 carbon atoms, and most preferably an alkyl group. $R_2$ is preferably an alkyl group of not more than 2 carbon atoms, most preferably methyl. $R_3$ and $R_4$ are preferably the same and most preferably either methyl or $-(C_2H_4O)_n$ H wherein n is a number of 5 to 15. Examples of suitable anions X include halide, e.g. chloride, iodide,or bromide; sulfate, acetate, hydroxide, methosulfate, ethosulfate, and the like.

Suitable anionic surfactants include the sulfates and sulfonates of the formulae (II):

$$R_6—SO_3M \quad (II)$$

wherein $R_6$ is a hydrocarbon group having from about 8 to about 22 carbon atoms which may be linked to the $—SO_3M$ moiety are alkoxy or oxyalkoxy. Preferably, $R_6$ is selected from the group consisting of

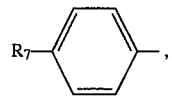

$R_8$, $R9-(OR_5)_m$ and $R_9$ $—O-(R_5O)_{m'}$, wherein $R_7$ is an alkyl radical of from 8 to about 18 carbon atoms, $R_8$ is a straight chain or branched, saturated or unsaturated aliphatic radical of from about 8 to about 22 carbon atoms, preferably alkyl or alkenyl of from about 10 to about 20 carbon atoms, $R_9$ is a hydrocarbon radical of from about 8 to about 22 carbon atoms, preferably a straight or branched, saturated or unsaturated aliphatic radical, e.g. alkyl or alkenyl, of from about 10 to about 20 carbon atoms, or an alkylphenyl radical having from about 8 to about 18 carbon atoms in its alkyl portion, $R_5$ is an alkylene of 2 to 4 carbon atoms, m is a number of from 1 to 25, preferably 2 to 20, and m' is a number of from 0 to 25, preferably 0 to 20, and M is a water-soluble cation.

Another suitable class of anionic surfactants are the phosphate ester types of the formula (III):

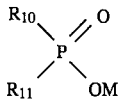

(III)

wherein $R_{10}$ is $R_{12}$ , $R_{11}$ is $R_{12}$ —O-(R$_5$O-)$_o$ or —OM, $R_5$ is an alkylene of 2 to 4 carbon atoms, o is a number of 1 to 25, $R_{12}$ is a hydrocarbon radical of from about 8 to about 22 carbon atoms, preferably an aliphatic radical, which may be straight or branched, and saturated or unsaturated such as alkyl or alkenyl of from about 10 to about 20 carbon atoms, and M is a water-soluble cation.

Still another class of anionic surfactants are the carboxylates or ethoxylated carboxylates of the formula (IV):

$$R_{13}COOM \quad (IV)$$

wherein $R_{13}$ is $R_{14}$ or $R_{14}$ —$OCH_2$ wherein a hydrocarbon radical of from about 7 to about 21 carbon atoms, and $R_5$, m and M are as defined.

Preferably, $R_7$ is an alkyl radical of 12 to 15 carbon atoms. $R_8$ preferably is an alkyl radical, most preferably of 12 to 18 carbon atoms. $R_9$ is preferably an alkyl radical, most preferably of 12 to 15 carbon atoms. $R_5$ is preferably ethylene; m is preferably a number of from 5 to 20, most preferably 5 to 10 and m' is preferably a number of from 0 to 20, preferably 0 or a number of from 5 to 10. M is preferably hydrogen, an alkali metal, ammonium or an amine, such as ($C_1$–$C_4$) alkanolamine. $R_{12}$ is preferably an alkyl group, most preferably of 12 to 22 carbon atoms. $R_{14}$ is preferably an alkyl radical, most preferably of 11 to 17 carbon atoms, or an alkylaryl radical, wherein the alkyl group has from 8 to 18, preferably 10 to 16 carbon atoms.

The anionic/cationic complexes of the present invention are readily obtained by merely mixing the desired anionic surfactant and the desired cationic surfactant in aqueous solution. Water solubility of the complex, so formed, is generally assured if the complex contains at least six $R_5O$ groups, as defined above, preferably 8–10 ethylene oxide groups. Variations are possible taking into account the presence of unneutralized charge in the complex and/or the size of the hydrophobic portion.

In one embodiment of the invention the cationic surfactant is of the formula

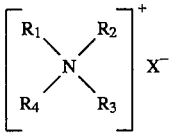

wherein $R_1$ is an alkyl or alkenyl radical containing from about 8 to about 22 carbon atoms, $R_2$, $R_3$ and $R_4$, which may be the same or different, each represent an alkyl group of not more than 6 carbon atoms, and X is halide 1; and said at least one anionic surfactant is of the formula

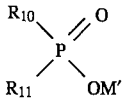

wherein $R_{10}$ is $R_{12}$ —O-(R$_5$O-)$_o$, $R_{11}$ is $R_{12}$ —O-(R$_5$O-)$_o$ or —OM', $R_5$ is an alkylene of 2 to 4 carbon atoms, preferably ethylene, o is a number of 1 to 25, preferably 2 to 20, $R_{12}$ is a hydrocarbon radical of from about 8 to about carbon atoms, and M' is a hydrogen ion or an alkali metal, especially sodium or potassium; wherein the total number of $R_5O$ groups is at least 6; or is of the formula $$R_9—O-(R_5O-)_m—SO_3M$$

wherein $R_5$ is an alkylene group of 2 to 4 carbon atoms, especially ethylene, $R_9$ is a hydrocarbon radical from about 8 to about 22 carbon atoms, preferably from about 10 to 18 carbon atoms, such as alkyl, alkenyl or alkaryl, M is an alkali metal, preferably sodium, or ammonium, or amine, preferably ethanolanine, and m is a number of at least 6.

In another embodiment of the invention, the at least one anionic surfactant is of the formula

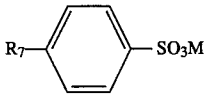

wherein $R_7$ is an alkyl radical of from 8 to about 18 carbon atoms, and

M is an alkali metal, preferably sodium, or ammonium, or amine, preferably ethanolanine; and the at least one cationic surfactant is of the formula

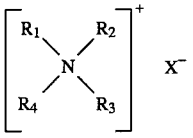

wherein $R_1$ is an alkyl or alkenyl radical containing from about 12 to about 22 carbon atoms, $R_2$ is an alkyl group of not more than 6 carbon atoms, $R_3$ and $R_4$ each represent -(R$_5$O-)$_n$ H, wherein $R_5$ is an alkylene of 2 to 4 carbon atoms, preferably ethylene, and the total number of $R_5O$ groups is at least 5, preferably at least 6, and X is halide, e.g. bromide, chloride or iodide, preferably bromide or chloride.

In a still further embodiment of the invention, the at least one anionic surfactant is of the formula $R_{13}COOM$ wherein $R_{13}$ is $R_{14}$ or $R_{14}O-(R_5O)_m-CH_2-$, wherein $R_{14}$ is an alkyl radical of from about 7 to about 21 carbon atoms, or an alkylaryl radical wherein the alkyl group has from about 8 to about 18 carbon atoms, preferably 10 to 16 carbon atoms, and $R_5$, m and M have the same definitions as given above, preferably $R_5$ is ethylene, m is from 5 to 20 and M is sodium; and the at least one cationic surfactant is of the formula

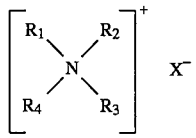

wherein $R_1$ is an alkyl or alkenyl radical containing from about 8 to about 22 carbon atoms, $R_2$ is an alkyl group of not more than 6 carbon atoms, $R_3$ and $R_4$ each represent $-(R_5O)_nH$, wherein $R_5$ is an alkylene of 2 to 4 carbon atoms, preferably ethylene, and the total number of $R_5O$ groups is at least 5, preferably at least 6, and X is halide, e.g. bromide, chloride or iodide, preferably chloride or bromide.

It should be understood that n, m, m', o and p represent average numbers, since the alkoxylated molecules usually comprise a mixture of molecules with different degrees of alkoxylation.

The aqueous solution of anionic/cationic complex may also and generally does include water soluble builder salts. Water-soluble inorganic alkaline builder salts which can be used alone with the detergent compound or in admixture with other builders are alkali metal carbonates, borates, phosphates, polyphosphates, bicarbonates and silicates. (Ammonium or substituted ammonium salts can also be used). Specific examples of such salts are sodium tripolyphosphate, sodium carbonate, sodium tetraborate, sodium pyrophosphate, potassium pyrophosphate, sodium bicarbonate, potassium tripolyphosphate, sodium hexametaphosphate, sodium sesquicarbonate, sodium mono and diorthophosphate, and potassium bicarbonate. The alkali metal silicates are useful builder salts which also function to make the composition anticorrosive to washing machine parts. Sodium silicates of $Na_2O/SiO_2$ ratios of from 1.6/1 to 1/3.2 especially about 1/2 to 1/2.8 are preferred. Potassium silicates of the same ratios can also be used.

Various other detergent additives or adjuvants may be present in the detergent product to give it additional desired properties, either of functional or aesthetic nature. Thus, there may be included in the formulation, minor amounts of soil suspending or anti-redeposition agents, e.g. polyvinyl alcohol, fatty amides, sodium carboxymethyl cellulose, hydroxy-propyl methyl cellulose; optical brighteners, e.g. cotton, amine and polyester brighteners, for example, stilbene, triazole and benzidine sulfone compositions, especially, sulfonated substituted triazinyl stilbene, sulfonated naphthotriazole stilbene, benzidine sulfone, etc., most preferred are stilbene and triazole combinations.

Bluing agents such as ultramarine blue; enzymes, preferably proteolytic enzymes, such as subtilisin, bromelin, papain, trypsin and pepsin, as well as amylase type enzymes; bactericides, e.g. tetrachlorosalicylanilide, hexachlorophene; fungicides; dyes; pigments (water dispersible); preservatives; ultraviolet absorbers; anti-yellowing agents, such as sodium carboxymethyl cellulose, complex of $C_{12}$ to $C_{22}$ alkyl alcohol with $C_{12}$ to $C_{18}$ alkylsulfate; pH modifiers and pH buffers; color safe bleaches, perfume, and anti-foam agents or suds suppressors, e.g. silicon compounds, can also be used.

The bleaching agents are classified broadly, for convenience, as chlorine bleaches and oxygen bleaches. Chloride bleaches are typified by sodium hypochlorite (NaOCl), potassium dichloroisocyanurate (59% available chlorine), and trichloroisocyanuric acid (85% available chlorine). Oxygen bleaches are represented by sodium and potassium perborates and potassium monopersulfate. The oxygen bleaches are preferred. Bleach stabilizers and/or activators, such as, for example, tetraacetylethylene diamine, can also be included.

Suitable ranges of the detergent additives are: enzymes—0 to 2%, especially 0.7 to 1.3%; corrosion inhibitors—about 0 to about 5%, and preferably 0.1 to 2%; anti-foam agents and suds suppressors—0 to 4%, preferably 0 to 3%, for example 0.1 to 3%; soil suspending or anti-redeposition agents and anti-yellowing agents—0 to 4%, preferably 0.5 to 3%; colorants, perfumes, brighteners and bluing agents total weight 0% to about 2% and preferably 0% to about 1%; pH modifiers and pH buffers—0 to 5%, preferably 0 to 2%; bleaching agent—0% to about 40% and preferably 0% to about 25%, for example 2 to 20%; bleach stabilizers and bleach activators 0 to about 15%, preferably 0 to 10%, for example, 0.1 to 8%. In the selections of the adjuvants, they will be chosen to be compatible with the remaining constituents of the composition.

The anionic/cationic complex generally comprises about 30% by weight of the aqueous solution, however, up to about 60% by weight of the anionic/cationic complex may be replaced by conventional nonionic detergents without loss of efficacy. Although maximum cleaning performance is observed when the molar ratio of anionic to cationic surfactant is about 1:1 enhanced cleaning performance for many types of soils and fabrics can be obtained over substantially broader molar ratios, preferably in the range of from about 9:1 to 1:9, more preferably from about 3:1 to 1:3. A typical heavy duty aqueous liquid detergent composition formulation comprises:

| Substance | (A) wt % | (B) Ranges (wt %) |
|---|---|---|
| ALFONIC 1214-65-ES[1)] | 10.00 | 2–20% |
| NEODOL 25-3[2)] | 4.00 | 0–10% |
| NEODOL 23-6.5[3)] | 12.00 | 0–20% |
| ARQUAT 1253[4)] | 3.20 | 1–10% |
| $Na_2CO_3$ | 2.00 | 0–5% |
| Triethanolamine | 0.50 | 0–2% |
| UNPA[5)] | 0.25 | 0–2% |
| GLYCERINE | 3.33 | 0–10% |
| V-BOR[6)] | 1.33 | 0–5% |
| PERFUME DYNADET | 0.40 | 0–2% |
| ALCAMYL[7)] | 1.00 | 0–3% |

[1)]Ethoxylated $C_{12}$ to $C_{14}$ alcohol sulfate (8–10 EO)
[2)]$C_{12}$–$C_{14}$ fatty alcohol condensed with 3 moles ethylene oxide (EO)
[3)]$C_{12}$–$C_{15}$ fatty alcohol condensed with 6.5 moles, on average, of ethylene oxide
[4)]Monotallow trimethyl ammonium chloride
[5)]Optical brightener (anionic from Ciba-Geigy)
[6)]Borax pentahydrate
[7)]Enzyme A detergency comparison between this composition (A) and a commercially available liquid detergent product was carried out and results are shown in the following Table:

DETERGENCY COMPARISON
(MULTI-SOIL AND STAIN TEST)

| Stain/Soil | Fabric | Commercial Product | Invention |
|---|---|---|---|
| GRAPE JUICE | D(65)/C(35)[A] | 79.61 | 71.81 |
| GRAPE JUICE | QIANA JERSEY | 64.14 | 60.34 |
| BLUEBERRY PIE | COTTON/ PERCALE | 71.98 | 70.99 |
| BREWED TEA | D(65)/C(35)[A] | 84.96 | 82.23 |
| CRANBERRY JUICE | D(65)/C(35)[A] | 85.83 | 83.55 |
| CRANBERRY JUICE | QIANA JERSEY | 87.48 | 84.52 |
| BEEF LIVER BLOOD | COTTON/ PERCALE | 82.40 | 81.96 |
| CHOCOLATE FUDGE PUD. | D(65)/C(35)[A] | 83.19 | 77.06 |
| CHOCOLATE FUDGE PUD. | QIANA JERSEY | 85.47 | 81.26 |
| POTTING SOIL | QIANA JERSEY | 75.55 | 76.86 |
| POTTING SOIL | DACRON DKNIT[B] | 69.66 | 69.95 |
| BANDY BLACK CLAY | QIANA JERSEY | 80.80 | 81.98 |
| BANDY BLACK CLAY | DACRON DKNIT[B] | 75.00 | 76.89 |
| LIQUID MAKEUP | COTTON/ PERCALE | 41.27 | 50.50 |
| LIQUID MAKEUP | D(65)/C(35)[A] | 61.41 | 79.92 |
| LIQUID MAKEUP | QIANA JERSEY | 49.20 | 82.97 |
| LIQUID MAKEUP | DACRON DKNIT[B] | 48.04 | 86.07 |
| SPANGLER SEBUM/PARTIC. | DACRON DKNIT[B] | 73.46 | 84.86 |
| BIC BLACK PEN INK | D(65)/C(35)[A] | 28.31 | 30.19 |
| BARBECUE SAUCE | DACRON DKNIT[B] | 70.11 | 80.92 |
| RED CRISCO SHORTENING | DACRON DKNIT[B] | 54.11 | 64.58 |
| FRENCH DRESSING | DACRON DKNIT[B] | 76.70 | 77.33 |
| TESTFABRICS SOIL | NYLON TRICOT | 67.62 | 62.39 |
| TESTFABRICS SOIL | COTTON/ PERCALE | 42.00 | 37.45 |
| PISCATAWAY CLAY | COTTON/ PERCALE | 72.52 | 74.53 |
| PISCATAWAY CLAY | D(65)/C(35)[A] | 82.45 | 83.81 |
| OILY SOIL EMPA-101 | COTTON/ PERCALE | 23.70 | 30.14 |
| TOTALS FOR ALL 27 SWATCHES | | 1,816.97 | 1,925.18 |
| AVERAGE FOR ALL 27 SWATCHES | | 67.30 | 71.30 |

[A]65° Dacron•/35% cotton blend?
[B]Dacron• double knit

Experiment I—Formation of water-soluble anionic/cationic surfactant complexes

A. Materials

Tetradecyltrimethylammonium bromide (TTAB) (purity=99%) was purchased from Sigma Chemical Co. (St. Louis, Mo.). Alkylpolyethoxy (9EO) sulfate (AEOS) and Emphos PS-236, an organic alkoxy phosphate ester (APE), were obtained from Witco Chemical Co. (Perth Amboy, N.J.). The general molecular structure of AEOS and APE are shown below as I and II respectively. All the materials were used without further purification.

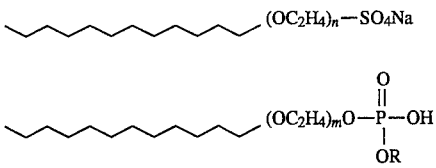

Figure 1:
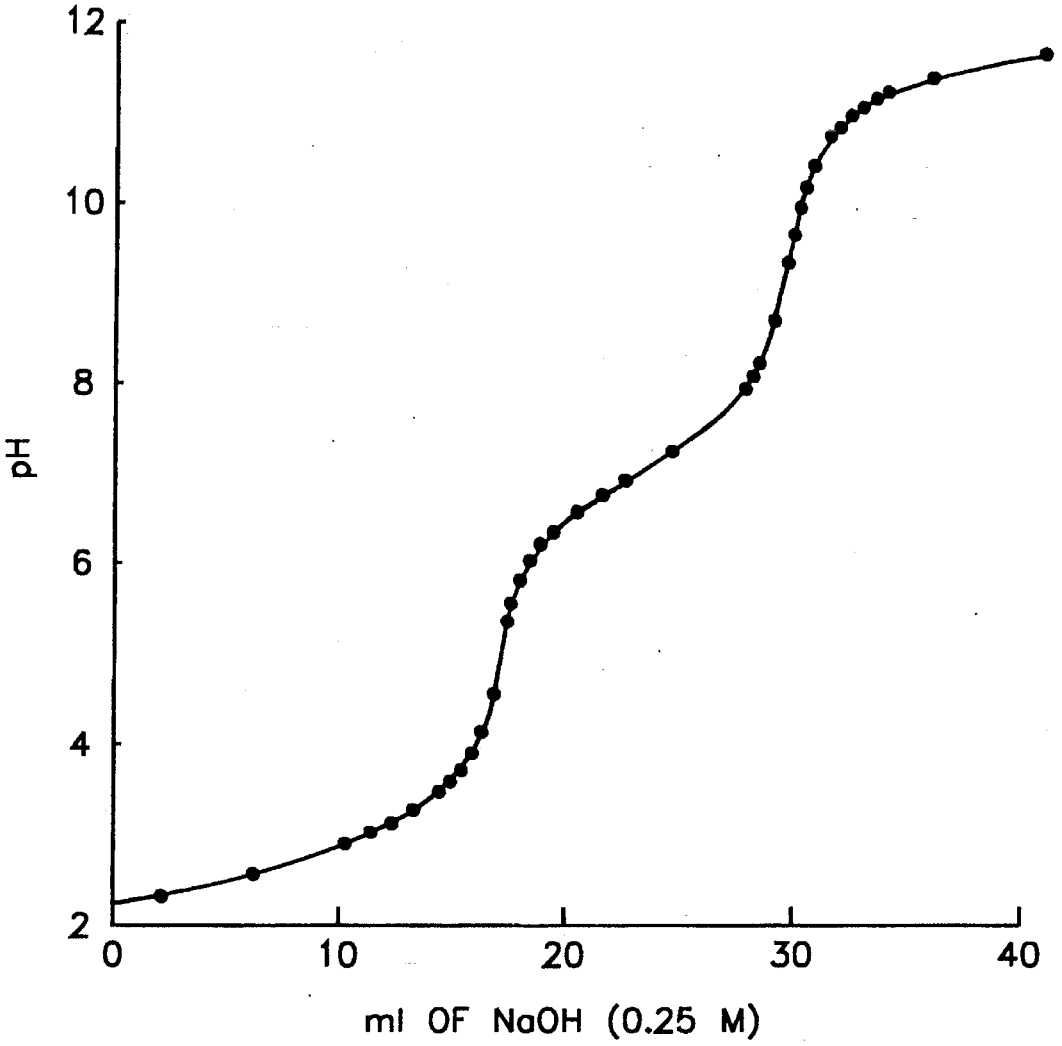
FIG. 1 is a graph of the pH of an aqueous solution of an alkoxy phosphate ester vs. the amount of NaOH added during titration.

Emphos PS-236 is characterized as a complex of mono- and di-ester phosphate of hydroxy-terminated alkoxide condensate. According to the manufacturer, the batch used in this experiment has an average molecular weight of 750 and contains 2.21% free phosphoric acid. It contains approximately 55% by weight ethylene oxide (EO) moiety. It is a mixture of of di-alkylpolyethoxy phosphate (where R is one of the alkylpolyethoxylates) and 40% of mono-alkylpolyethoxy phosphate (where R is hydrogen). Titration of 1.0% Emphos PS-236 aqueous solution with 0.10M NaOH indicates two end points due to the two protons on the monoester molecules (FIG. 1).

AEOS was analyzed for its carbon chain and ethylene oxide (EO) distributions by thin layer chromatography. Its carbon chain distribution was 27.9% as $C_{12}$, 36.3% as $C_{13}$, 20.5% as $C_{14}$, and 15.2% as $C_{15}$. Its EO distribution is shown in Table 1. From Table 1, the average moles of EO per mole of alcohol (ALC) is 8.7 and the average molecular weight of the alcohol portion is calculated to be 587 (without the $SO_3^-$ and $Na^+$) resulting in 690 as the molecular weight for the AEOS. According to the manufacturer, the molecular weight of the AEOS batch used is 700 and it is supplied as 24% aqueous solution.

TABLE 1

| EO | MOLES ALC | MOLES EO | WT % |
|---|---|---|---|
| 0 | .00934 | 0 | 1.896 |
| 1 | .00398 | .00398 | .982 |
| 2 | .00519 | .01038 | 1.510 |
| 3 | .00588 | .01764 | 1.970 |
| 4 | .00813 | .03251 | 3.080 |
| 5 | .01089 | .05447 | 4.608 |
| 6 | .01280 | .07678 | 5.976 |
| 7 | .01574 | .11016 | 8.041 |
| 8 | .01608 | .12866 | 8.926 |
| 9 | .01556 | .14007 | 9.323 |
| 10 | .01401 | .14007 | 9.007 |
| 11 | .01124 | .12365 | 7.722 |
| 12 | .00951 | .11413 | 6.953 |
| 13 | .00830 | .10791 | 6.433 |
| >13 | .02369 | .42645 | 23.573 |

B. Methods 1. pH of TTAB/APE 5 grams of APE was dissolved in 50 grams of water. This acidic solution was titrated with a 0.40 molar solution of TTAB. The pH change during the titration was monitored and recorded using Sargent Welch pH 6000 meter.

2. Surface and Interfacial Tensions

Using a du Nouy ring tensiometer, the surface tension vs. surfactant concentration of solution of (a) AEOS alone, (b) TTAB alone and (c) a 1:1 mole ratio mixture of AEOS and TTAB were measured. In addition, several solutions of AEOS/TTAB with different molar ratios of AEOS to TTAB were prepared. The total surfactant concentration of all the solutions was kept constant at 0.01 molar. The interfacial tensions between these solutions and hexadecane (oil) were measured using a spinning drop tensiometer (EOR, Inc.; Houston, Tex.).

3. Cloud Point Temperature Measurements

In order to measure the cloud point temperatures of anionic and cationic surfactant mixtures, the following stock solutions were first prepared:

(1) APE solution: 500 ml of approximately 0.02M solution was prepared by dissolving 7.5 grams of APE in deionized water in a volumetric flask.

Figure 2:
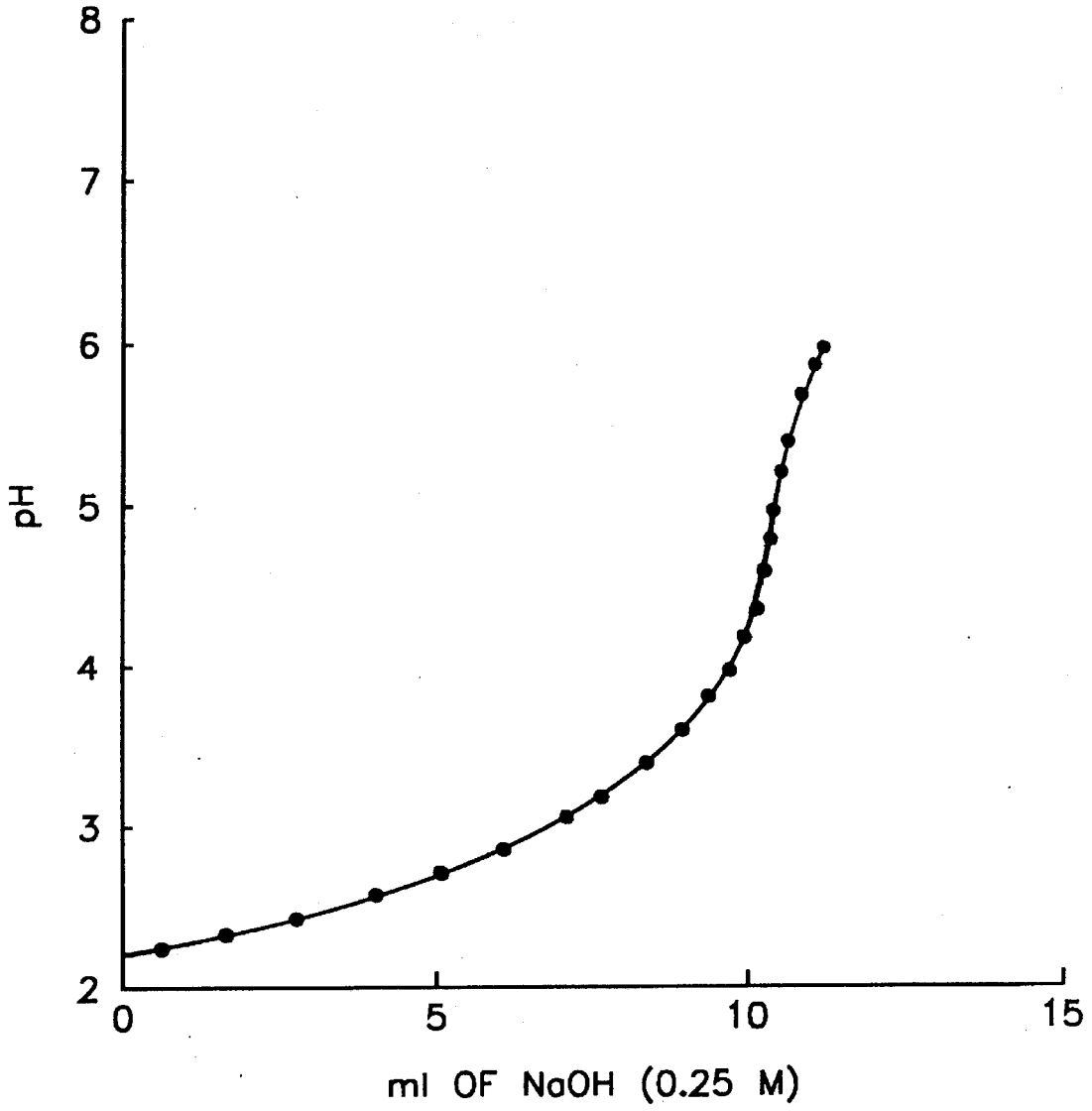
FIG. 2 is a graph of the pH of an aqueous solution of an alkoxy phosphate ester vs. the amount of NaOH added in titration to just past the first equivalent point.

(2) Partially Neutralized APE: 11 grams of 0.1M NaOH was added dropwise to 100 ml of the above 0.02M APE solution to slightly past the first equivalent point. The pH of the solution was measured during the addition of the NaOH and the degree of neutralization of the final solution is shown in FIG. 2.

Figure 3:
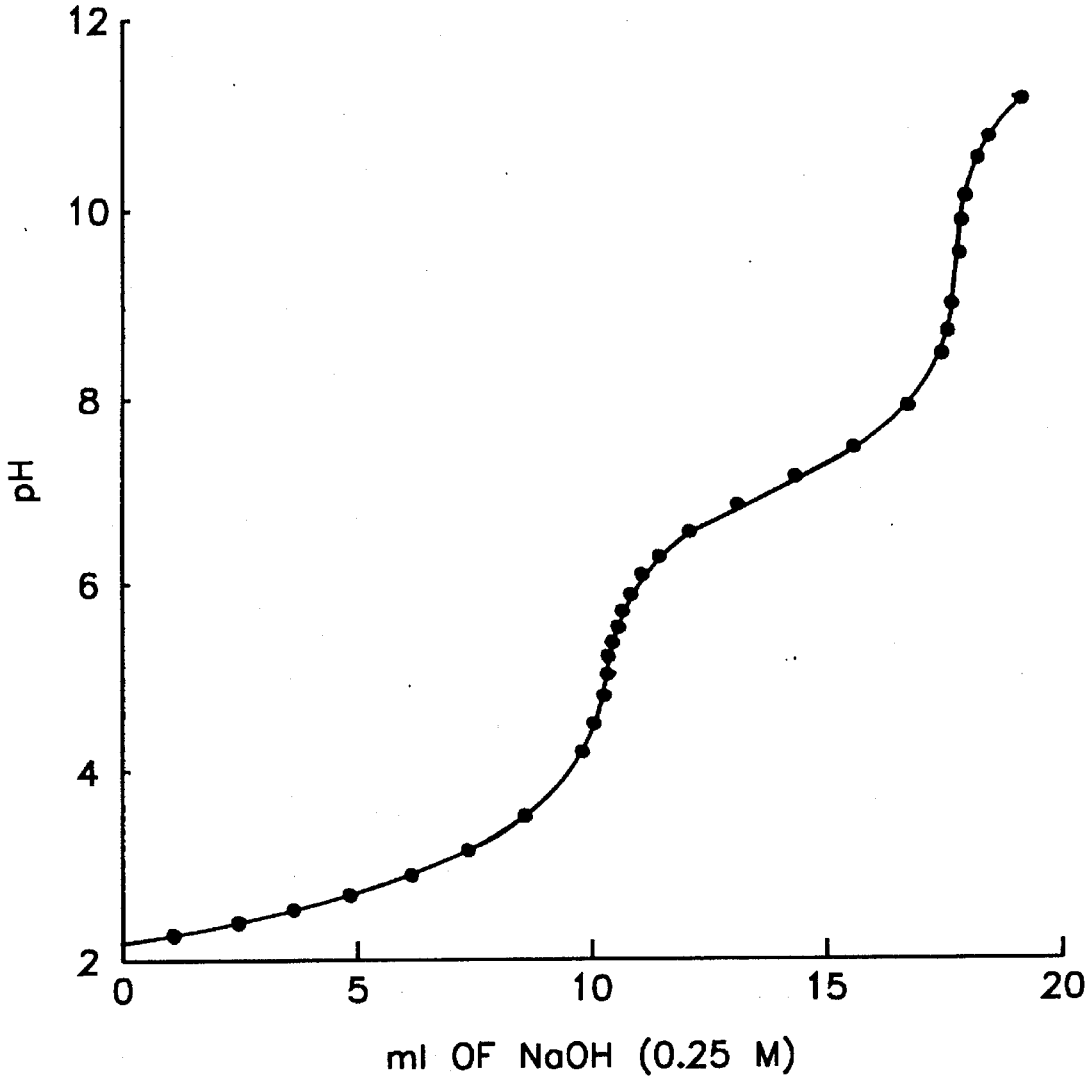
FIG. 3 is a graph of the pH of an aqueous solution of an alkoxy phosphate ester vs. the amount of NaOH added in titration to just past the second equivalent point.

(3) Completely Neutralized APE: 18.83 grams of 0.1M NaOH was added dropwise to another 100 ml of 0.02M APE solution to completely neutralize the solution. The degree of neutralization is shown in FIG. 3.

(4) TTAB Solution: 0.02M and 0.20M solutions were prepared by dissolving 3.36 and 33.6 grams of TTAB respectively in deionized water in 500 ml volumetric flasks.

(5) AEOS Solution: Approximately 0.02M and 0.2M solutions were prepared assuming molecular weight to be 690 and 24% activity (both numbers supplied by Witco for the batch used).

Using the above stock solutions several aqueous solutions of the following sets of surfactant mixtures were prepared:

(a) TTAB/Acidic APE with different molar ratios but constant total surfactant concentration.

(b) TTAB/Partially Neutralized APE with different molar ratios but constant total surfactant concentration.

(c) TTAB/Totally Neutralized APE with different molar ratios but constant total surfactant concentration.

(d) TTAB/AEOS with different molar ratios but constant total surfactant concentration (e) TTAB/AEOS with constant molar ratios but different total surfactant concentration.

The cloud point temperatures were measured by immersing 10 ml vials containing the above solutions in a water bath heated on a hot plate. The temperature in the bath was monitored by a thermometer immersed in the bath throughout the heating process. A collimated white light shining through the solution was used to help early detection of the cloud point.

EXAMPLE 1 pH of APE/TTAB Solution

Figure 4:
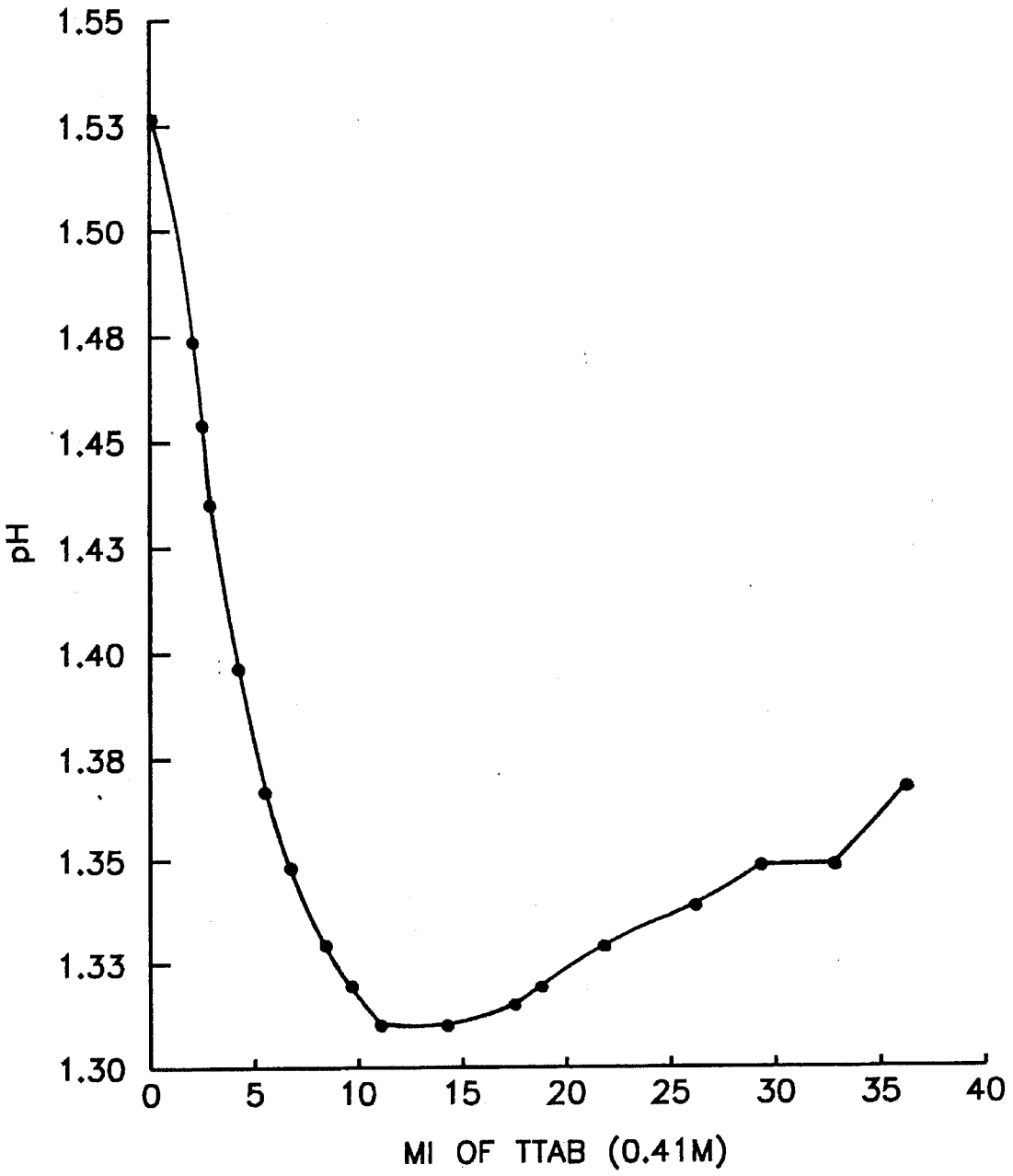
FIG. 4 is a graph of the pH of an aqueous solution of an alkoxy phosphate ester vs. the amount of tetradecyltrimethylammonium bromide added during titration.

An aqueous solution of APE is quite acidic (FIG. 1) while an aqueous solution of TTAB is neutral. Yet, the pH of the already acidic APE aqueous solution decreased sharply with the addition of TTAB aqueous solution up to a certain amount beyond which it started to increase gradually (FIG. 4).

The decrease in pH of the APE aqueous solution with the addition of TTAB suggests that the tetradecyltrimethylammonium ion is complexed with the APE replacing $H^+$ from the undissociated acid, i.e.

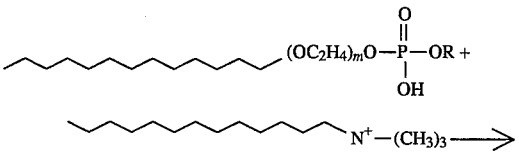

-continued

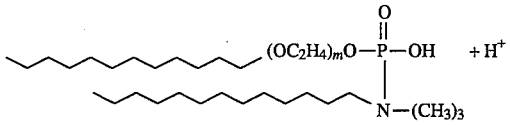

The occurrence of the minimum at an APE/TTAB mole ratio of about 1:1 tends to confirm the above reaction. The increase in pH after the minimum is most likely due to the dilution of the neutral TTAB solution.

EXAMPLE 2

Surface and Interfacial Tensions

Figure 5:
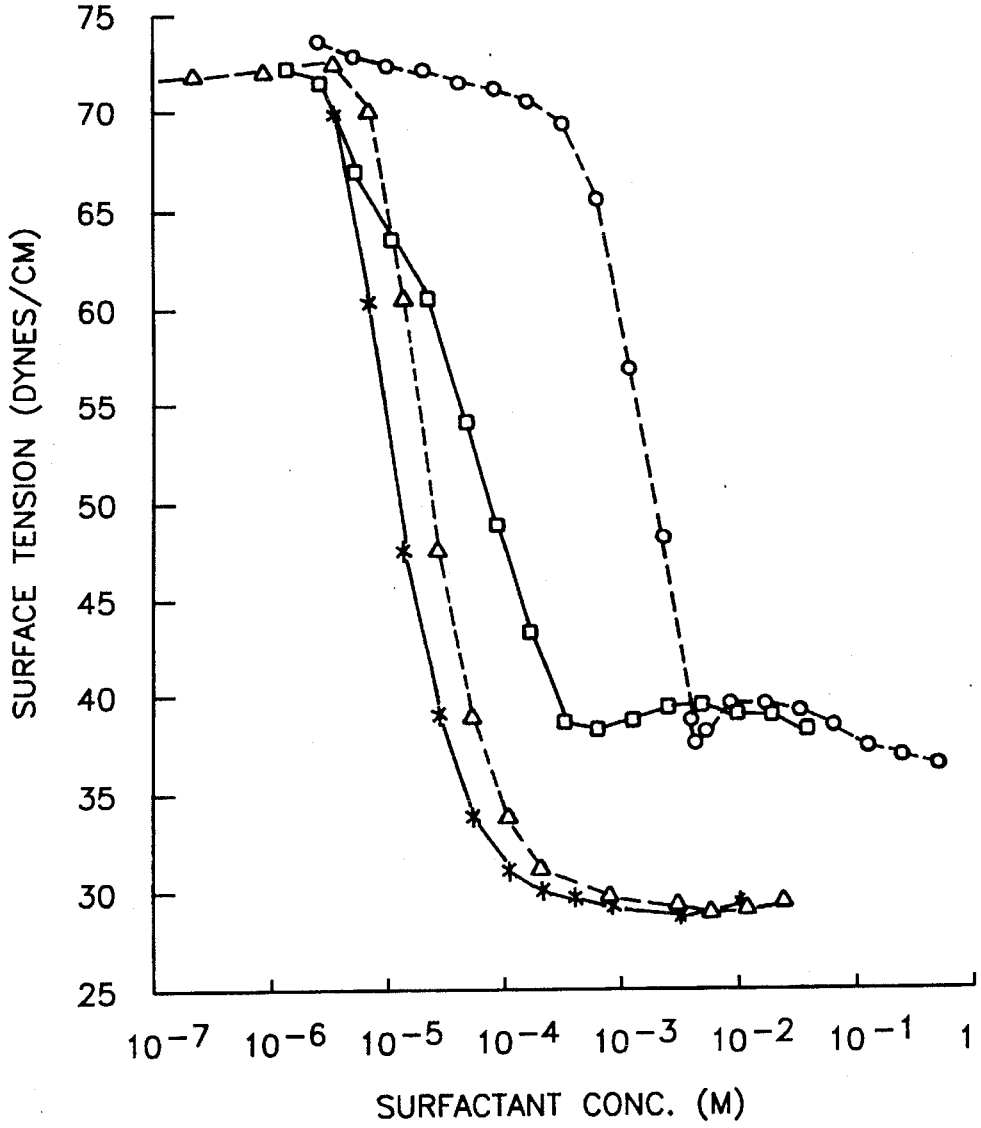
FIG. 5 is a graph of surface tension vs. surfactant concentration for various aqueous solutions of surfactants and mixtures thereof.

The surface tension vs. surfactant concentration profiles of AEOS alone, TTAB alone and a 1: 1 molar ratio mixture of AEOS and TTAB are shown in FIG. 5. The critical micelle concentration (cmc) of TTAB is measured to be about $4\times10^{-3}$M, which is close to a literature value of $3.5\times10^{-3}$M (Venable et al., J. Phys. Chem., 68, p. 3498 (1964)). The cmc of AEOS is measured to be about $2.5\times10^{-4}$M, an order of magnitude lower than that of the TTAB. However, the lowest surface tension that can be attained at high surfactant concentration is the same for both surfactants, about 37 dynes/cm. On the other hand, the cmc and the lowest surface tension attained at high surfactant concentration of the 1:1 AEOS/TTAB mixture are $4\times10^{-5}$M and 29 dynes/cm respectively, significantly lower than either of the AEOS or TTAB solutions alone. This strong synergism in surface tension reduction effectiveness and efficiency implies the formation of a new active moiety.

Figure 6:
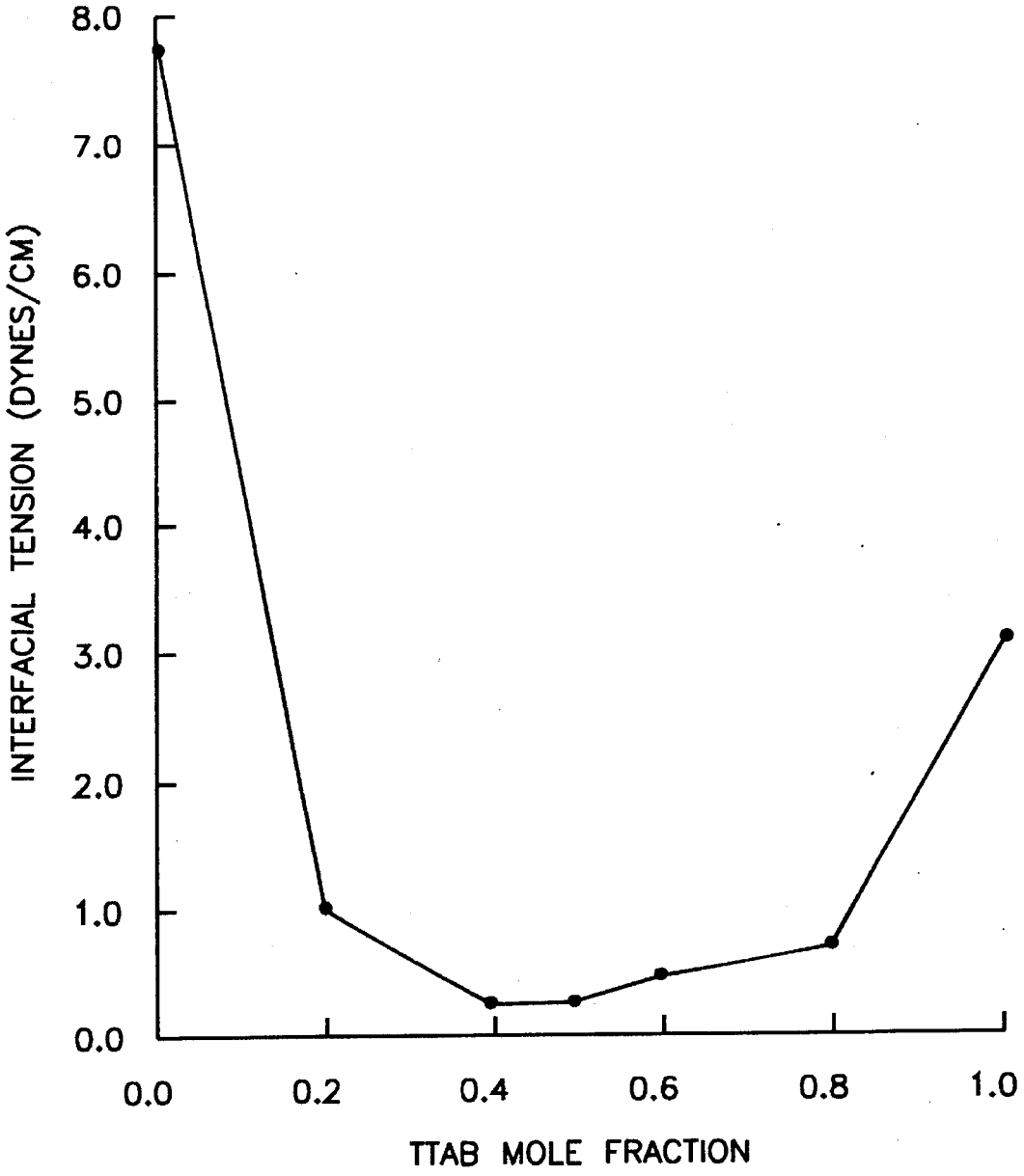
FIG. 6 is a graph of hexadecane/water interfacial tension vs. the mole fraction of tetradecyltrimethylammonium bromide in a tetradecyltrimethylammonium bromide/alkylpoly (ethyleneoxide) sulfate mixture dissolved in the water.

The interfacial tensions of the AEOS/TTAB solutions with hexadecane are shown in FIG. 6. The results indicate that minimum interfacial energy is attained with approximately equimolar composition of anionic and cationic surfactants.

EXAMPLE 3

Cloud Point Temperatures

Some aqueous surfactant solutions become cloudy at a specific temperature when heated. Upon setting, the cloudy solutions separate into two liquid phases—one aqueous-like and the other oily-like, presumably surfactant poor and surfactant rich phases, respectively. This cloud point behavior is characteristic of ethoxylated nonionic surfactants and has been studied extensively (Mitchell et al., J. Chem. Soc., Faraday Trans. 1, 79, p. 975 (1983)). Anionic surfactants are not known to exhibit cloud point behavior. Cloud point behavior has been observed in the present study of mixtures of APE and TTAB as will be discussed in detail below. This "pseudo-nonionic" behavior is taken as additional evidence that cationic-anionic complexes are formed in these mixtures. Cloud point phenomenon in nonionic polyethylene oxide surfactants is believed to be due to micellar aggregation (Tanford et al., J. Phys. Chem., 81, p. 1555 (1977); Elworthy et al., J. Chem. Soc. 1963, p. 907; and Atwood, D., J. Phys. Chem., 72, 339 (1968)). The size of the surfactant aggregates increases as the temperature is raised towards the cloud point. The hydration force derived from the attraction between the head groups and water gives a repulsive force between lipid aggregates. Nonionic surfactants are dehydrated as the temperature is increased. This implies that the hydration induced repulsion force between nonionic micelles will also decrease with increasing temperature. As the cloud point temperature is approached a balance between this force and the van der Waals force occurs resulting in secondary aggregation and phase separation. In the cloud point phenomena described below, the ethoxylated portion of the postulated neutral complexes of APE and TTAB and AEOS and TTAB provides the "pseudo-nonionic" behavior resulting in the cloud point phenomena by the same general mechanisms applicable to a true nonionic.

Figure 7:
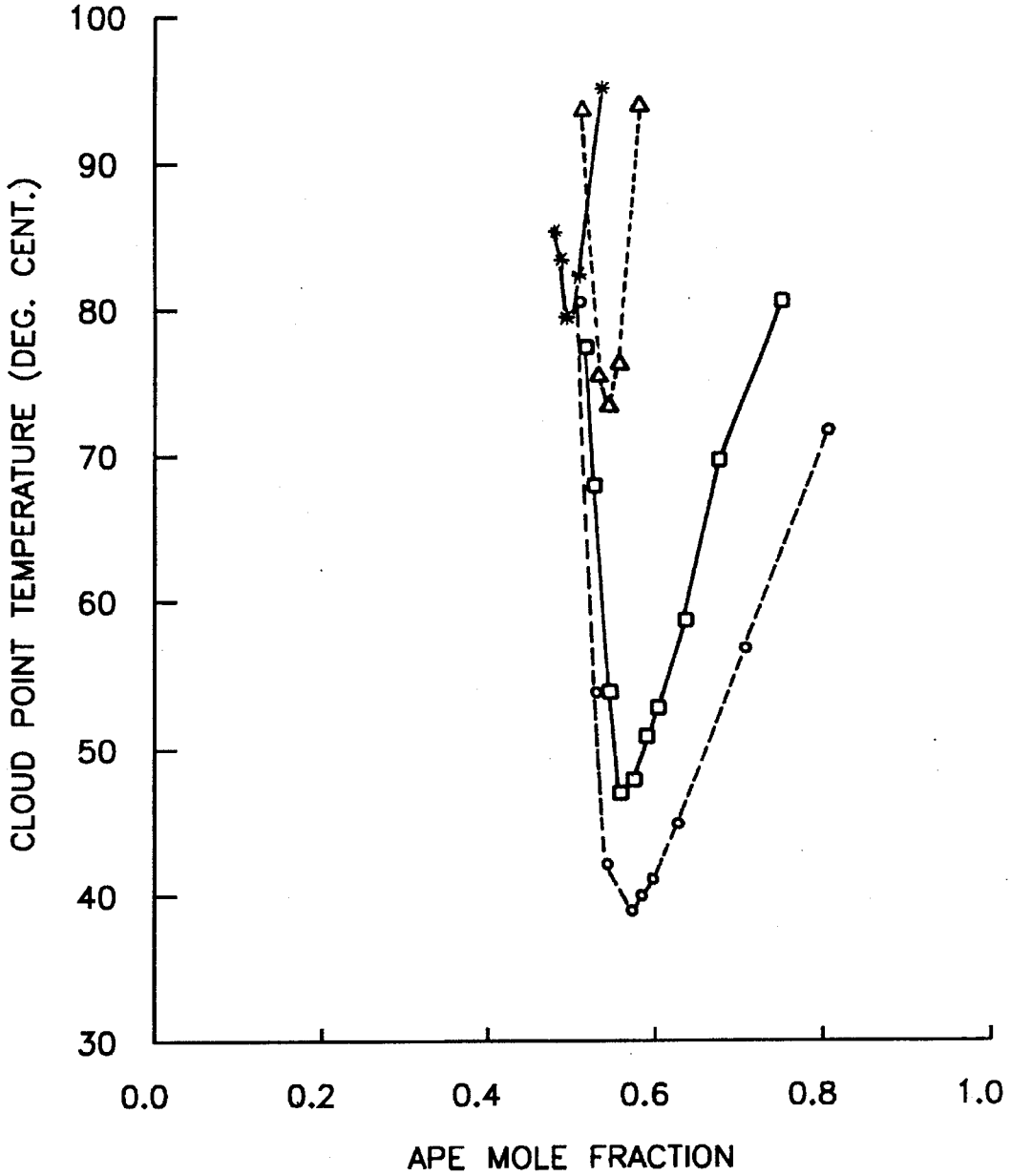
FIG. 7 is a graph of cloud point temperature vs. the mole fraction of anionic component in various anionic/cationic mixtures.

APE/TTAB: The cloud point temperatures of the solutions of APE/TTAB and partially neutralized APE/TTAB are shown in FIG. 7. No cloud point temperature was observed for the mixtures of TTAB and completely neutralized APE. The common feature in all the curves is the presence of a minimum which occurs at or close to the 1:1 anionic to cationic molar ratio (mole fraction=0.5). The main difference is in the location of the minima. The minima of TTAB/Acidic APE curves occur at APE molar fraction much greater than 0.5, while those of the TTAB/partially neutralized APE occur at APE mole fractions closer to 0.5. Moreover, the corresponding cloud point temperatures for the acidic APE/TTAB solutions are lower than those of the partially neutralized APE/TTAB solutions.

If cloud point is indeed due to recellar aggregates, then ionic surfactants' micelles would not aggregate due to electrostatic repulsion. In this study, however, the anionic and cationic surfactants neutralize each other. Around the 1:1 mole ratio, the mole ratio of the anionic and cationic surfactants in the micelles must be close to 1:1 resulting in micelles with no charge, thus eliminating electrostatic repulsion. Since one of the surfactants has ethylene oxide groups, the micelles must be behaving as though they are made up of "pseudo-nonionic" ethoxylated surfactants. With excess of either of the ionic surfactants, however, the micelles will be composed of the "pseudo-nonionic" and ionic surfactants and will be charged. The amount of ionic surfactant will affect the magnitude of the electrostatic repulsion needed, along with hydration forces, to overcome the van der Waals attractive forces between the micelles at a given temperature. This explains why the cloud point temperature increases with the increase of either the cationic or anionic surfactants in excess of the 1:1 mole ratio. This explanation is further supported by the fact that the cloud point temperature of nonionic surfactants is known to increase with the addition of ionic surfactants (Maclay, W. N., J. Colloid Sci., 11, p. 272 (1956) and Saito et al., J. Colloid Interface Sci., 24, p. 10 (1967)).

pH affects the location of the minima in the APE/TTAB solutions. Since APE is not completely dissociated in aqueous solution, the amount of ionized APE (i.e. deprotonated) must be less than the total amount of APE in the solution. Therefore, in order to deliver anionic APE which is equimolar to the TTAB in solution, more APE than TTAB must be introduced. How much more depends on the degree of dissociation of APE into its anionic form and proton, which in turn depends on the pH. This explains why the mole fraction of the minimum cloud point temperature of the TTAB/acidic APE occurs at 0.57 and not 0.50. At pH=4.87, however, which is exactly at the equivalent point, every APE molecule has only one charge (the monoester only partially neutralized) and therefore, the amount of ionic APE is almost equal to (approaches) the total amount of APE in solution. Therefore, the cloud point temperature minimum for such a system occurs at an APE mole fraction which is very close to 0.5.

Figure 8:
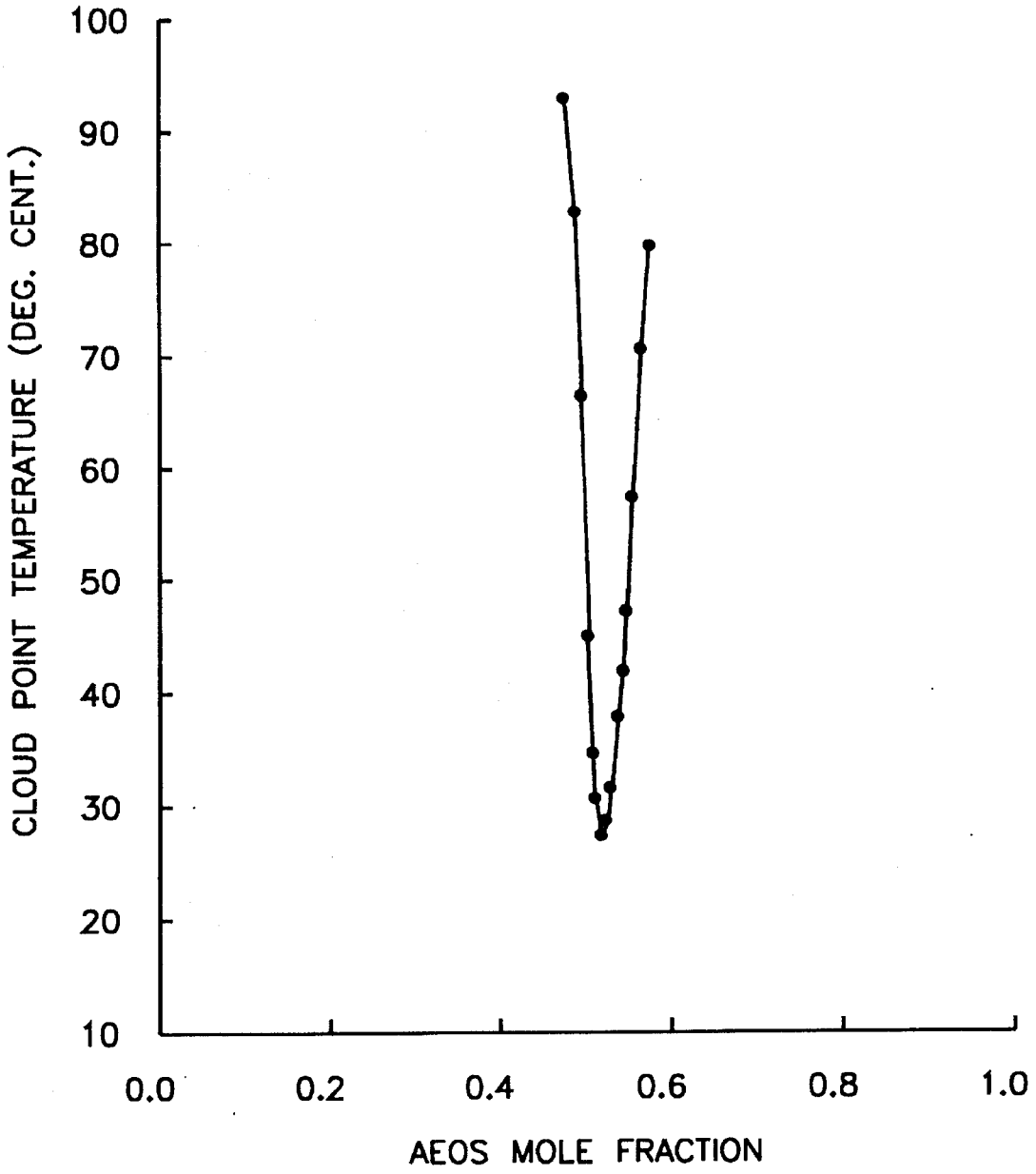
FIG. 8 is a graph of cloud point temperature vs. the mole fraction of anionic component in an anionic/cationic mixture.

AEOS/TTAB: Similar to the APE/TTAB solutions, cloud point temperature minima as low as 25° C. were also observed for AEOS/TTAB solutions. FIG. 8 shows cloud point temperature vs. AEOS mole fraction for an AEOS/TTAB system where the total surfactant concentration (AEOS+TTAB) is kept constant at 0.05M. Solutions with a mole fraction of less than 0.4 or greater than 0.6 of either the anionic or cationic surfactants did not become cloudy even when heated to 100° C.

Figure 9:
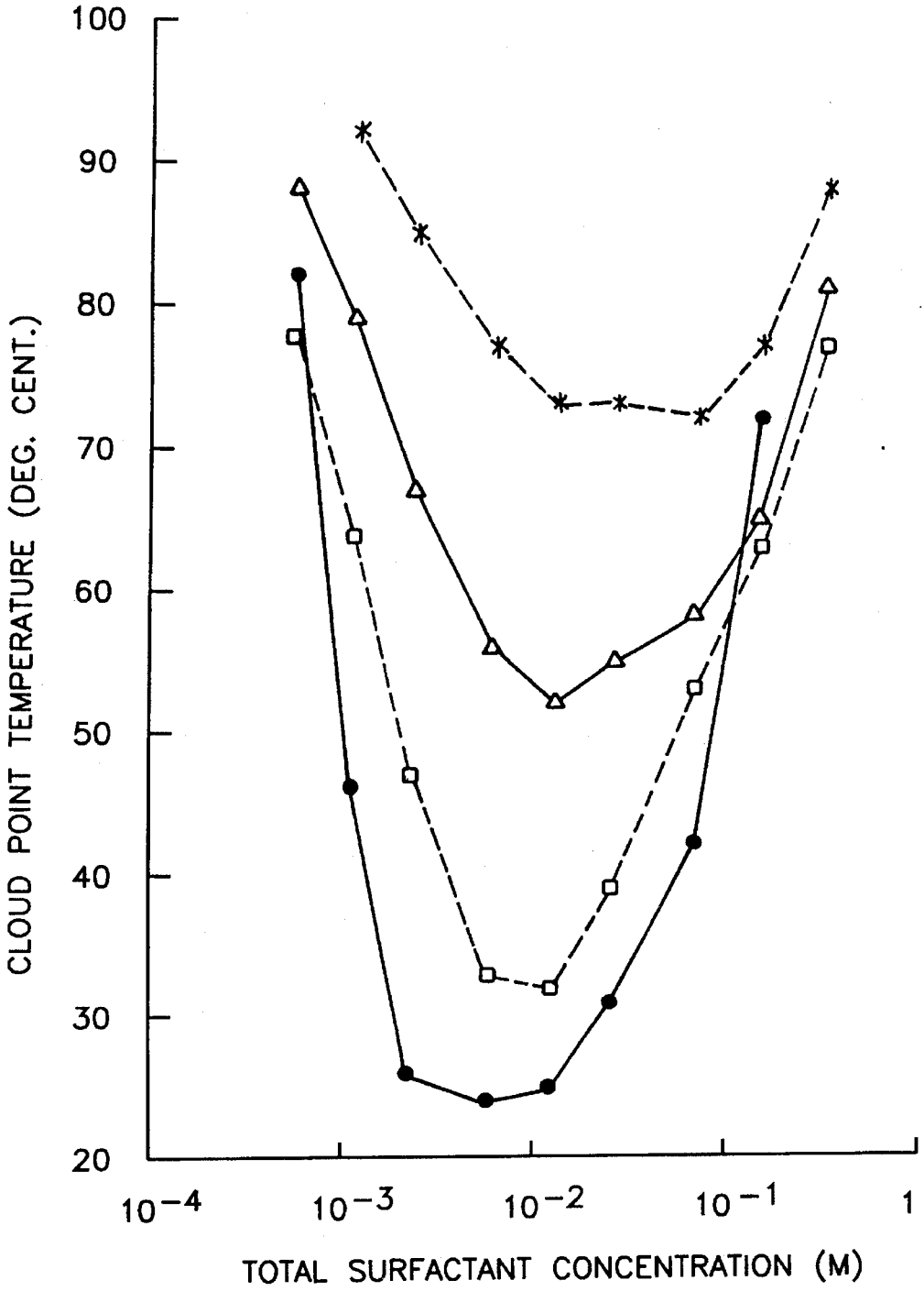
FIG. 9 is a graph of cloud point temperature vs. total surfactant concentration for various anionic/cationic mixtures.
Figure 10:
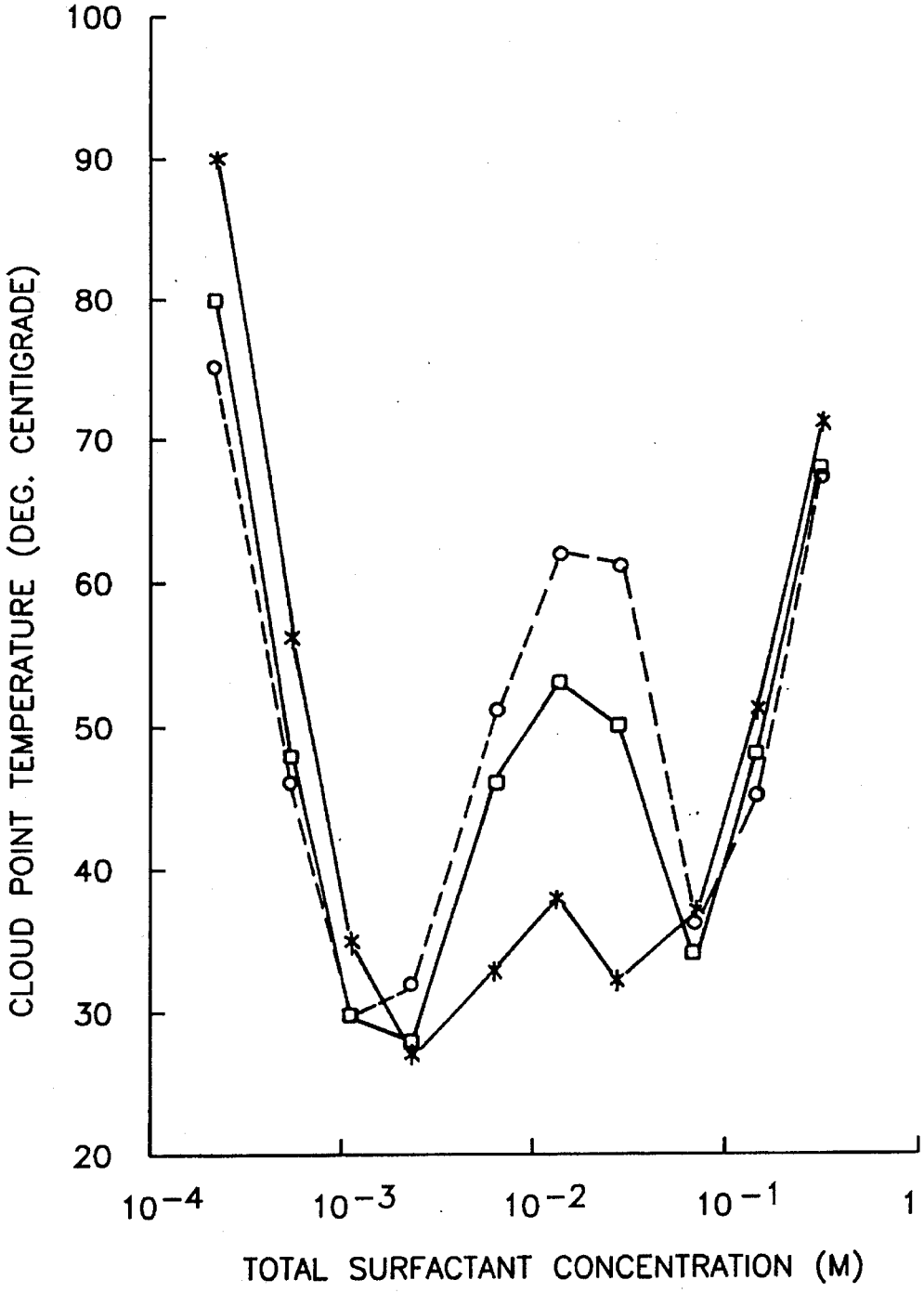
FIG. 10 is a graph of cloud point temperature vs. total surfactant concentration for various anionic/cationic mixtures.

The cloud point temperature of AEOS/TTAB solutions is found to be affected not only by the mole fractions of the surfactant components but also by the total surfactant concentration (AEOS+TTAB). FIGS. 9 and 10 show the dependence of cloud point temperature on the total surfactant concentration for solutions with different mole fractions of TTAB and AEOS. Solutions containing about equal or more AEOS than TTAB had only one minimum. The cloud point temperature at this minimum increased as the ratio of the AEOS to TTAB increased (FIG. 9), Solutions containing more TTAB showed two minima. While the cloud point temperature at the two minima remained about the same, the cloud point temperature of solutions with intermediate concentrations increased with an increase in TTAB to AEOS ratio (FIG. 10).

Assuming that the dissociation constant of the anionic-cationic complex (ion-pair) is very small, then AEOS/TTAB solutions may be treated as binary mixtures of the complex and AEOS, if AEOS is more than TTAB, or binary mixtures of the complex and TTAB, if TTAB is more than AEOS. (For discussion purposes the complicated mixture of AEOS molecules is treated as a single component.) The composition of a micelle of a binary mixture is affected both by the cmc's of the two surfactants and by the absolute and relative concentration of the surfactants (Rubingh, D. N., in "Solution Chemistry of Surfactants" (Mittel, K. L., ed.) Plenum Press, New York (1979), Vol. 1, p. 337). In dilute solutions, the ratio of the surfactant with lower cmc to that with higher cmc is greater in the micellar phase than in the aqueous phase. At low surfactant concentration of the solutions with excess TTAB, the micelles initially formed may be mainly composed of the complex since it has much lower cmc than the TTAB. These micelles would be uncharged and will lave low cloud point temperature. As the total surfactant concentration increases more TTAB may be inserted in the otherwise neutral micelles imparting charge. The repulsion between the micelles increases the cloud point temperature. Addition of more surfactant increases the micelie concentration. The decrease in intermicellar distance increases the van der Waals attractive forces thus lowering the cloud point temperature and forming another dip. This double dip in cloud point temperature is particularly obvious in the system with excess TTAB and not in the systems with excess AEOS because the difference in cmc between the complex and the TTAB is about 2 orders of magnitude while it is less than one order of magnitude between the complex and the AEOS.

EXAMPLE 4

Solubility

Most of the anionic and cationic mixtures generally studied have been such that their anionic and cationic components are those that form insoluble complexes at concentrations that are high enough for certain applications. The mixtures of the anionic and cationic surfactants noted above, i.e. AEOS or APE and TTAB, however, are very water soluble. The enhanced water solubility of these mixtures can be better understood if the causes of solubility of ionic and nonionic surfactants are first mentioned. The water solubility of ionic surfactants is attributed to their charged heads while the water solubility of nonionic surfactants is attributed to their polar functional groups (e.g., ethylene oxide groups). When a cationic and an anionic surfactant with no hydrophilic groups other than their charged heads are mixed, an insoluble complex is formed. This because the charged heads which were responsible for water solubility are neutralized. However, if the surfactants have hydrophilic groups in addition to their ionic heads, the resulting complex could be soluble. The degree of solubility will depend on the size of the hydrophilic group relative to the total hydrophobic portions of the two components, i.e. on the hydrophilic-lipophilic balance (HLB) of the entire complex. This balance is such with the above cationic and anionic surfactants to make the complexes water soluble.

Big complexes will be soluble if they have large number of EO groups to raise the hydrophilic/lipophilic balance such that water solubility is favored. Complexing anionic and cationic surfactants with hydrophilic groups on either or both surfactants would be a way of preparing "super" surfactants with large hydrophobic groups and yet soluble in water. A solution of such complex gives at least an order of magnitude lower interfacial tension with oil (e.g., hexadecane). Its critical micelle concentration is also lower than those of either of its components.

Thus, water-soluble anionic/cationic surfactant complexes can be formed. These complexes are more surface active than either of their anionic or cationic surfactant components; they are more efficient and effective. They lower oil/water interfacial tension by an order of magnitude over that obtained by their individual surfactant components, They exhibit cloud point behavior unlike any of their ionic surfactant components, the phenomena of cloud points having been associated mainly with nonionic ethoxylated surfactants.

Experiment II—Interfacial tension behavior

The interfacial tension between a variety of oils and various mixtures of APE and tetradecyltrimethylammonium bromide (TTAB) were measured, in the manner previously set forth. The results are set forth in Table II.

TABLE II

| Surfactant | APE | APE/TTAB 0.3 g/l-total) | | | TTAB |
|---|---|---|---|---|---|
| Oil | (1 g/l) | 4:1 | 2:1 | 1:1 | (1 g/l) |
| HEXA-DECANE | 3.0 ± .3 | 1.1 ± .2 | 1.1 ± .2 | 1.1 ± .2 | 4.9 ± .2 |
| NUJOL | 2.6 ± .3 | 1.1 ± .2 | 1.1 ± .1 | 1.5 ± .2 | 2.3 ± .1 |
| DIRTY MOTOR OIL | 1.3 ± .7 | 0.8 ± .1 | 0.8 ± .1 | 1.2 ± .3 | 1.4 ± .2 |
| WESSON OIL | 3.9 ± .6 | 1.4 ± .2 | 1.7 ± .3 | 1.6 ± .1 | 2.8 ± .6 |
| OLEIC ACID | 4.9 ± .9 | 4.7 ± .6 | 5.1 ± .7 | 5.6 ± .4 | 4.6 ± .6 |

Experiment III—Detergency of water-soluble anionic/cationic surfactant complexes A. Materials Anionic Surfactants AEOS—Alfonic 1214-65—a sodium salt of an alkylpoly-(oxyethylene)sulfonate (20.4% activity with a carbon chain length of 12 to 14 and 65% degree of ethoxylation (about 8–10 EO), was obtained from Vista Chemical Co. (Ponca City, Okla. 74602).

LDBS—Sodium salt of linear dodecylbenzylsulfonate (51.5% activity) was obtained from Colgate-Palmolive Co.

Soap—85% tallow and 15% coco—with 11% moisture was also obtained from Colgate-Palmolive Co.

Cationic Surfactants

The following ethoxylated cationic surfactants were obtained from Akzo Chemie America (ARMAK Chemicals): Ethoquad 18/15 (EQ 1815): 96% solution of methylbis $((C_2H_4O)_5H)$-octadecylammonium chloride. Ethoquad 18/20 (EQ 1820): 95% solution of methylbis$((C_2H_4O)_{10}H)$-octadecylammonium chloride. Ethoquad 18/25 (EQ 1825): 95% solution of methylbis$((C_2H_4O)_{15}H)$-octadecylammonium chloride. Ethoquad C/25 (EQ 25): 95% solution of methylbis$((C_2H_4O)_{15}H)$-cocoammonium chloride. Ethoquad T20-B (EQB T20): 75% solution of benzylbis $((C_2H_4O)_{10}H)$-octadecylammonium chloride.

B. Method

Dacron double knit fabrics stained with red Crisco shortening or sebum particulate are cut into 2.25"×2.25" pieces. Triplicates of such swatches and unstained ones were washed in a tergotometer. The total amount of surfactant (i.e. anionic+cationic) in each bucket was kept constant at $1\times10^{-3}$M while the mole fraction of the individual surfactants was varied in the range 0 to 1. Sebum stained swatches were washed at room temperature (80° F.), and Crisco stained swatches were washed at 120° F., for 15 minutes and rinsed for 5 minutes.

The detergency performance of the different systems were determined as follows. The Rd (reflectance) and "a" value (redness) of clean swatches and of stained swatches before and after they were washed were measured. The % cleaning was then calculated using the equation:

$$\frac{Rd_w - Rd_s}{Rd_{us} - Rd_s} \times 100$$

$Rd_{us}$ and $Rd_s$ are the reflectance readings of the unstained and stained swatches respectively and $Rd_w$ is the reflectance reading of the washed swatches. For the red Crisco stained swatches the corresponding "a" values could also be used. Reflectance measurements were performed on a Gardner reflectometer attached to an IBM PC.

C. Results

Figure 11:
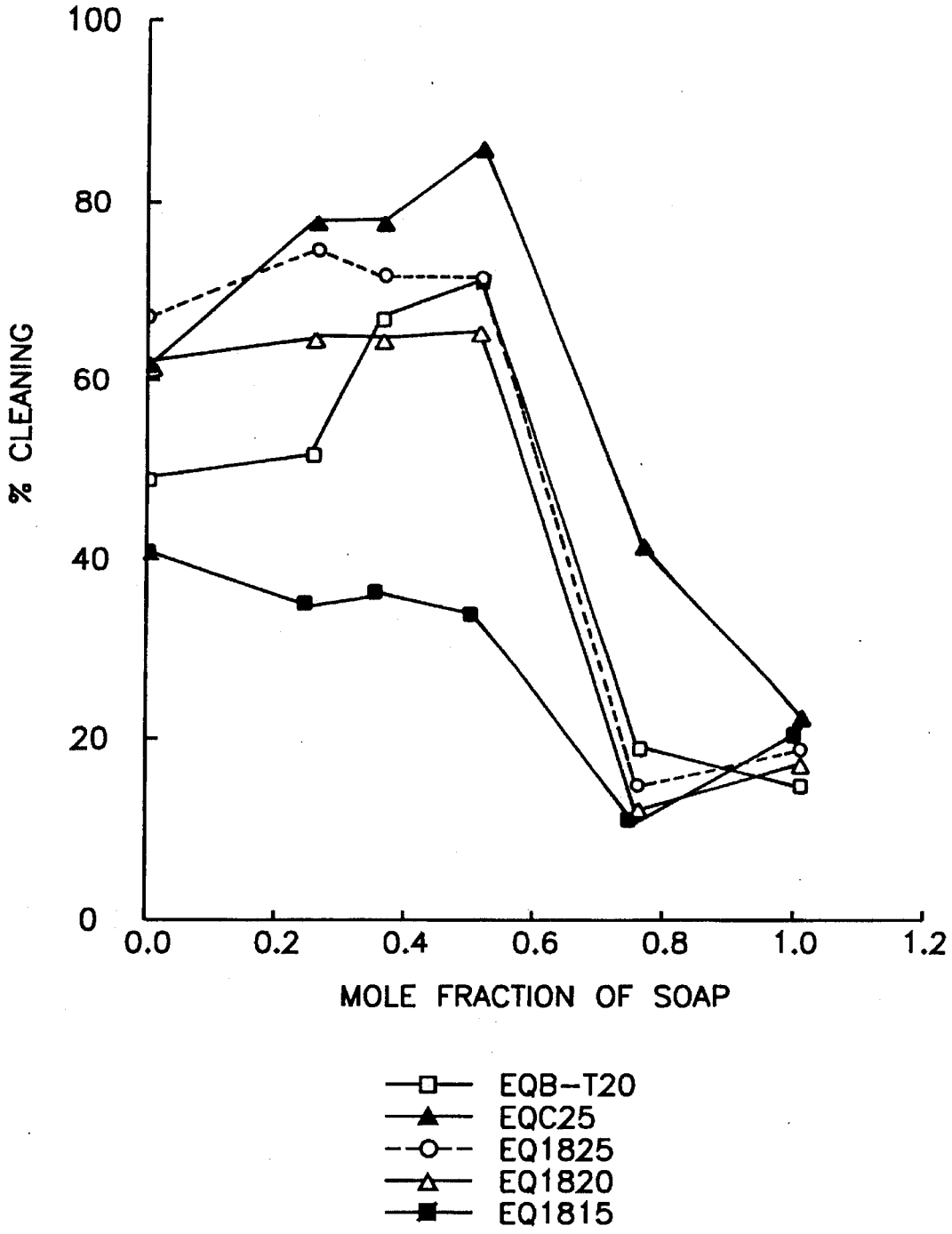
FIG. 11 is a graph of sebum detergency vs. mole fraction of soap in a soap/cationic mixture.
Figure 12:
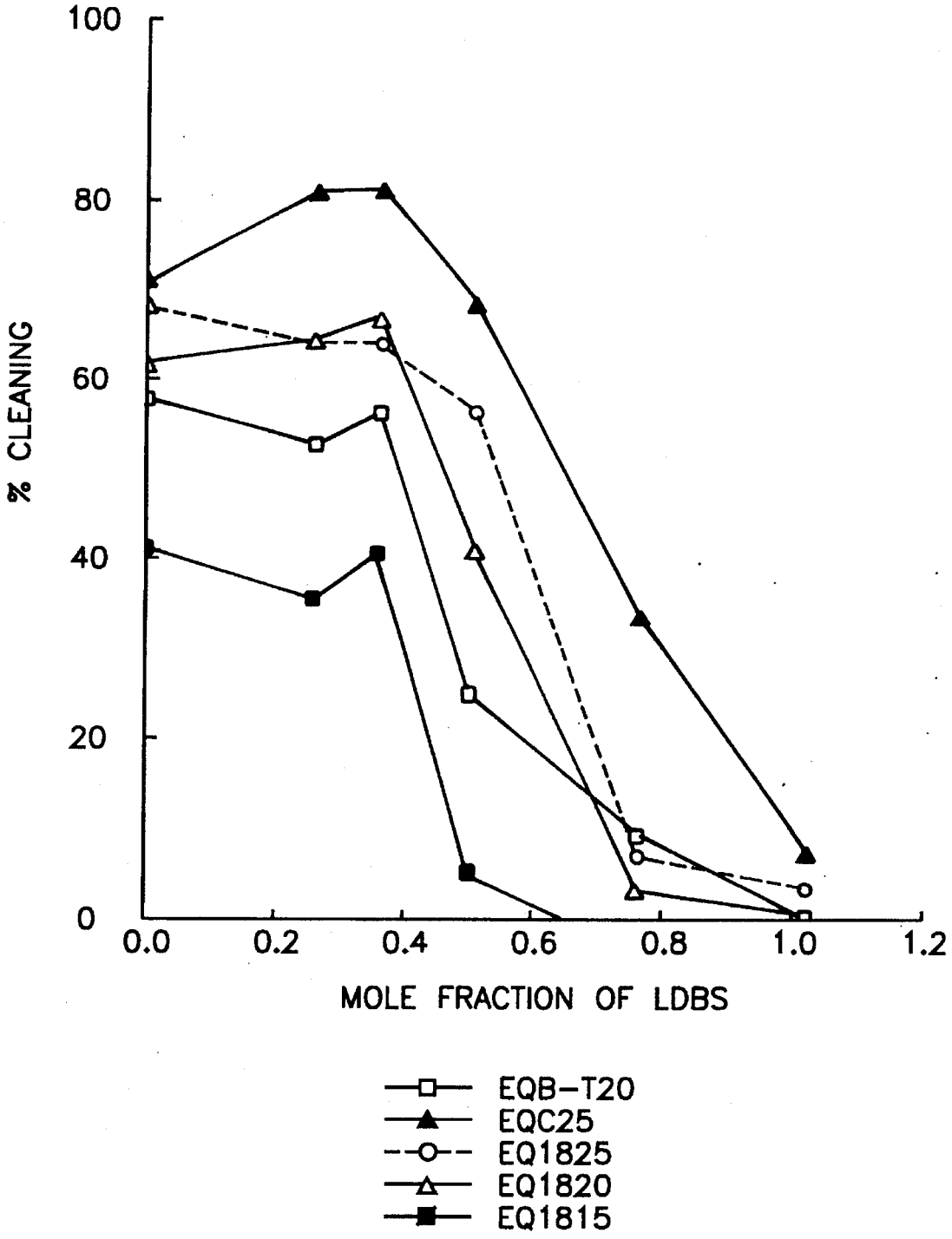
FIG. 12 is a graph of sebum detergency vs. mole fraction of synthetic anionic detergent in a synthetic anionic detergent/cationic mixture.
Figure 13:
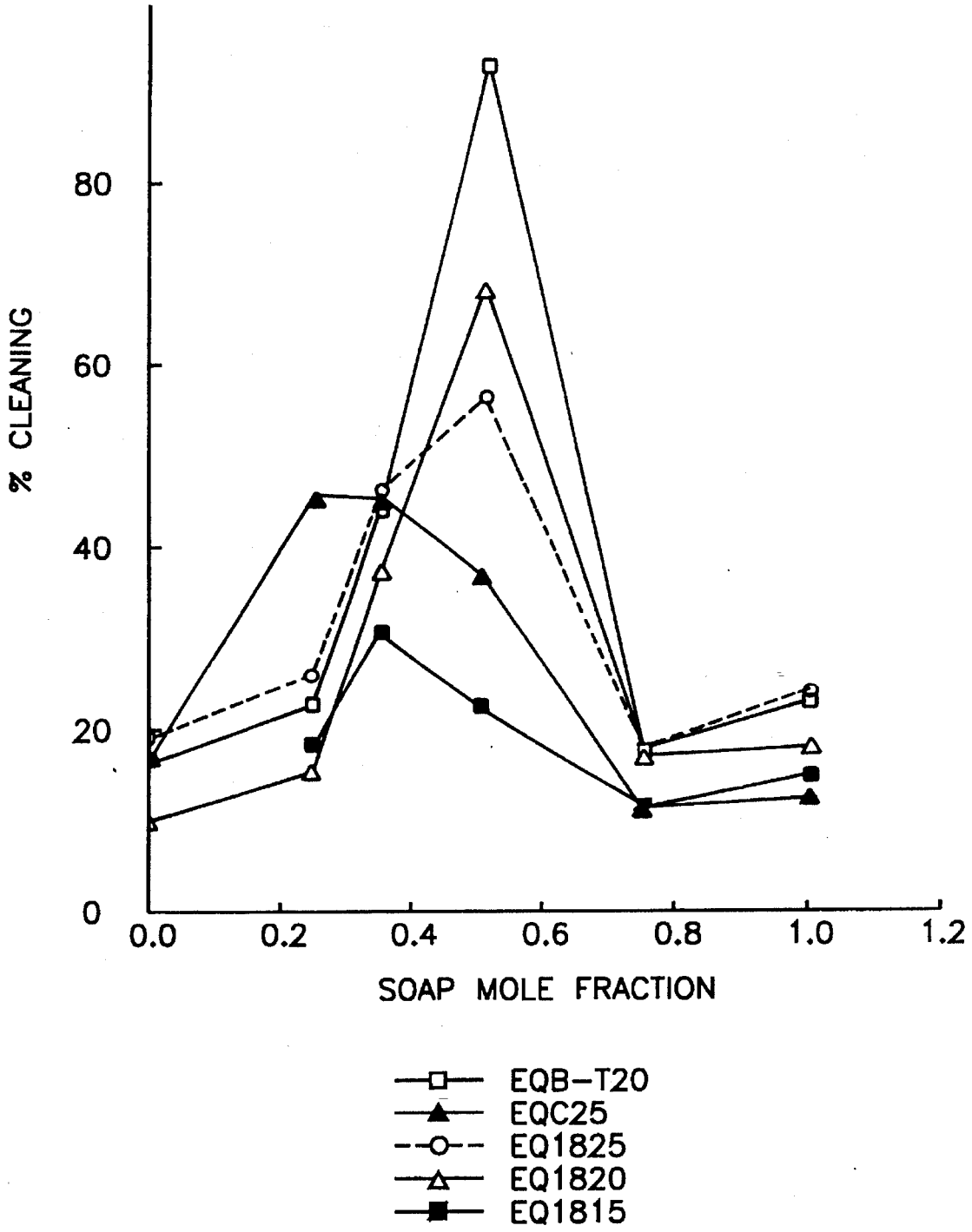
FIG. 13 is a graph of Crisco detergency vs. mole fraction of soap in a soap/cationic mixture.
Figure 14:
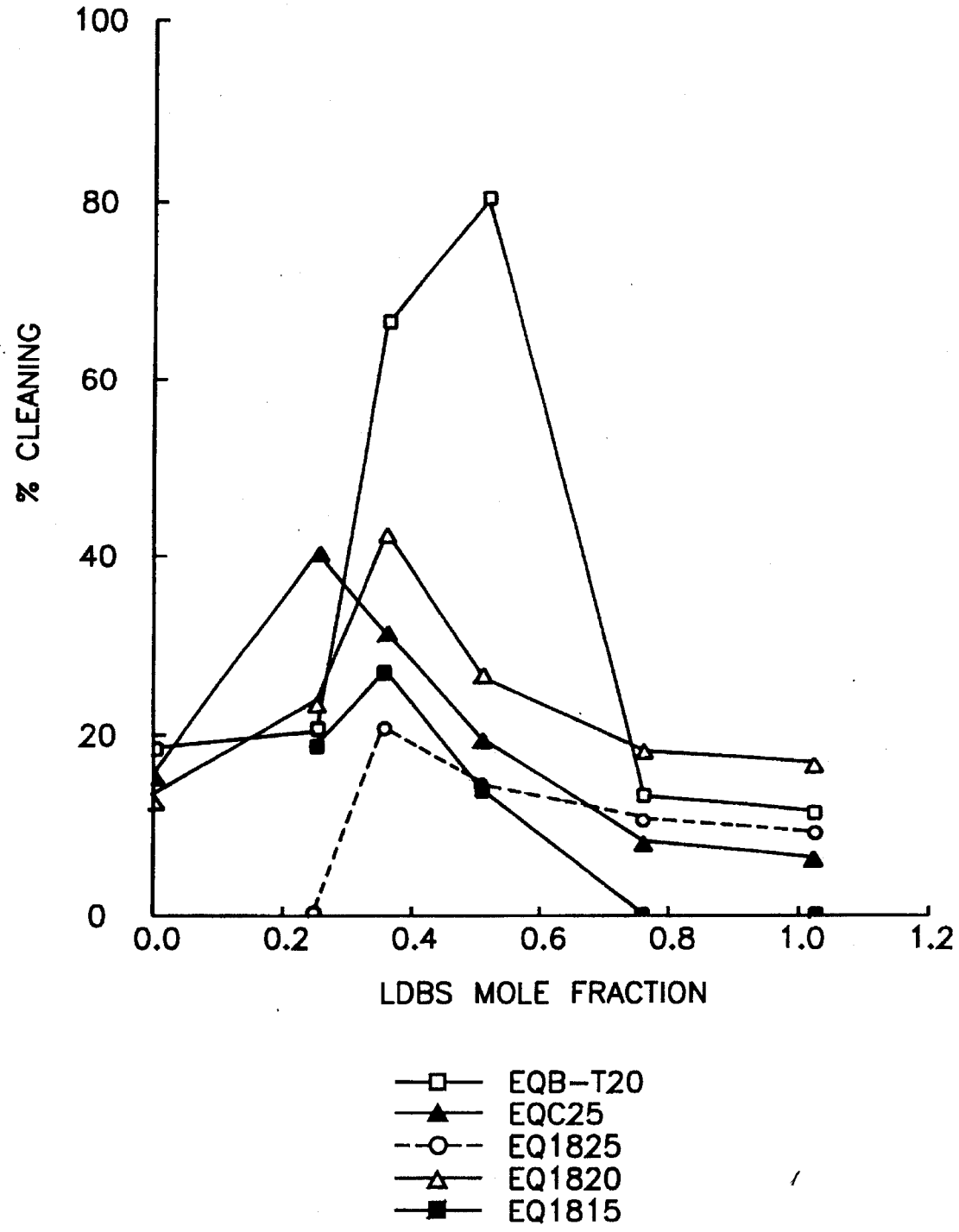
FIG. 14 is a graph of Crisco detergency vs. mole fraction of synthetic anionic detergent in a synthetic anionic detergent/cationic mixture.

FIGS. 11 and 12 show the % cleaning of sebum at 80° F. by the soap/ethoxylated quat and LDBS/ethoxylated quat systems respectively. FIGS. 13 and 14 show the % cleaning of red Crisco shortening at 120° F. by the soap/ethoxylated quat and LDBS/ethoxylated quat systems respectively.

The performance of a combination of the anionic and cationic surfactants was in general much better than that of either the anionic or cationic surfactants alone. The cleaning of the Crisco stained swatches were low when washed with the systems containing either excess anionic surfactants or excess ethoxylated cationic surfactants. For the sebum stained swatches, however, better cleaning was obtained when systems containing excess ethoxylated cationic surfactants, i.e. at anionic mole fraction less than 0.5. This sustained cleaning at anionic mole fractions of less than 0.5 may be due to the complexation of the excess ethoxylated cationic surfactants with the fatty acids of the sebum. This demonstrates that ethoxylated cationic surfactants could offer additional advantages when they are part of a complex because common oily soils such as sebum have anionic components, e.g. fatty acids. The fatty acids may combine with the ethoxylated cationic surfactants to form soluble complexes which, in addition to removing the fatty soils, will result in complexes capable of removing additional oily soils.

Experiment IV—Effects of temperature and builder on detergency of water-soluble anionic/cationic surfactant complexes A. Materials Sodium Carbonate: 0.25 molar concentration was prepared from anhydrous sodium carbonate from J. T. Baker Chemical Co. (Phillipsburg, N.J. 08865).

0.25M aqueous solutions were prepared from each of the following anionic and cationic surfactants:

Anionic Surfactants

AEOS—Alfonic 1214-65 —a sodium salt of an alkylpoly(oxyethylene)sulfate (20.4% activity) with a carbon chain length of 12 to 14 and 65% degree of ethoxylation, was obtained from Vista Chemical Co. (Ponca City, Okla. 74602). Soap—85% tallow and 15% coco—with 11% moisture was obtained from Colgate-Palmolive Co.

Cationic Surfactants

Tetradecyltrimethylammonium bromide ($C_{14}$TAB) was purchased from Sigma Chemical Co., St. Louis, Mo. 63178. Dodecyltrimethylammonium bromide ($C_{12}$TAB) was also purchased from Sigma Chemical Co., The following ethoxylated cationic surfactants were obtained from Akzo Chemie America (ARMAK Chemicals):

Ethoquad 18/15 (EQ 18-15)—96% solution of methylbis(5-hydroxyethyl)octadecylammonium chloride.

Ethoquad 18/20 (EQ 18-20)—95% solution of benthylbis(10-hydroxyethyl)octadecylammonium chloride.

Ethoquad 18/25 (EQ 18-25)—95% solution of methylbis(15-hydroxyethyl)octadecylammonium chloride.

Ethoquad C/25 (EQC-25)—95% solution of methylbis(15-hydroxyethyl)cocoammonium chloride.

B. Method

Effect of Sodium Carbonate

Dacron double knit fabrics stained with red Crisco shortening or sebum/particulate were cut into 2.25"×2.25" pieces. Duplicates of such swatches were washed in a tergotometer. The total amount of surfactant (i.e. anionic+cationic) in each bucket was kept constant at $1\times10^{-3}$M while the mole fraction of the individual surfactants was varied in the range 0 to 1. All the tergotometer buckets contained different amounts (ranging from 0 to 4.5 grams) of the 0.25M aqueous solution of sodium carbonate. Sebum stained swatches were washed at room temperature (80° F.), and Crisco stained swatches were washed at 120° F., for 15 minutes and rinsed for 5 minutes. Effect of Temperature The detergency on sebum/particulate stained dacron double knit (DDK) swatches and Crisco shortening (dyed red) stained swatches by soap, Ethoquad C-25 (EQC-25) and mixtures thereof were measured after washing them in a tergotometer at 60° F., 80° F., 100° F., 120° F. and 140° F. as follows:

A 6-bucket tergotometer was used. In buckets 1–3 duplicates of the sebum stained swatches (2.5"×2.5") were used. In buckets 4–6 duplicates of Crisco stained swatches (2"×2") were used. Each bucket contained 1 liter of deionized water. In addition, 1.5 grams of the 0.25M soap solution to buckets 1 and 6, 1.5 grams of the 0.25M Ethoquad C-25 to buckets 3 and 4 and 1.5 grams of a 1:1 mixture of the 0.25M solutions of Ethoquad C-25 and soap to buckets 2 and 5 were added. Different sets of swatches were washed for 15 minutes for each of the above temperatures. They were then immersed in 2 liters of cold water and rinsed gently by hand.

The dependence of detergency on time nature of the complex and temperature was studied by washing Crisco and sebum stained swatches in a tergotometer by several complexes differing in the size of their hydrophobic and hydrophilic components. Each complex was tested at several temperatures ranging from 40° F. to 140° F. but only for the sebum stained swatches. Table III shows the surfactant contents of each of the tergotometer buckets.

TABLE III

Surfactant Contents of Each Tergotometer Bucket

| Bucket No. | Complex |
|---|---|
| 1 | $C_{14}$TAB/AEOS |
| 2 | $C_{12}$TAB/AEOS |
| 3 | EQC-25/Soap |
| 4 | EQ 18-25/Soap |
| 5 | EQ 18-20/Soap |
| 6 | EQ 18-15/Soap |

Stock solutions of each pair of anionic and cationic surfactants were prepared by mixing equal amounts of 0.25M solutions of each of the anionic and cationic surfactants, resulting in at least 15 grams of 0.125M of the anionic/cationic complexes. This is to ensure that identical ratios of the anionic to the cationic surfactants in the complex are used in different runs. 1.5 grams of each of the resulting solutions were put in 1 liter of deionized water in the corresponding tergotometer buckets shown in Table III which were first heated or cooled in the desired washing temperature. Duplicates of sebum or Crisco swatches were put in each bucket and washed for 15 minutes at time appropriate temperatures. Crisco swatches were washed at only 121° F., while sebum detergency was tested at 40°, 60°, 80°, 100°, 120° and 140° F. for each of the anionic/cationic complexes shown in Table III. The swatches were rinsed by immersing them in 2 liters of cold water twice.

The detergency performance of the different systems were determined as follows. The Rd (reflectance) and "a" value (redness) of clean swatches and of stained swatches before and after they were washed were measured on both sides of the swatches using a Gardner reflectometer attached to an IBM PC/AT. The percent cleaning was calculated using the equation:

$$\frac{Rd_w - Rd_s}{Rd_{us} - Rd_s} \times 100$$

$Rd_{us}$ and $Rd_s$ are the reflectance readings of the unstained and stained swatches respectively and $Rd_w$ is the reflectance reading of the washed swatches. For the red Crisco stained swatches the corresponding "a" values were used. Reflectance measurements were performed on a Gardner reflectometer attached to an IBM PC. Reflectance of unstained dacron double knit (DDK) swatches were measured to be Rd=89.5±0.3 and a=0.62±0.02. Reflectance for sebum/particulate were Rd=45.7±1.4 and a=0.14±0.05. Crisco stained swatches were different than sebum stained swatches in that they had lighter sides and darker sides both before and after washing. Therefore, reflectance was measured for both sides of the swatches. The overall values for both sides of the unwashed Crisco stained swatches were Rd=31.6±0.9 and a=53.6±1.7, while for the lighter sides Rd=30.8±0.0 and a=55.2±0.1 and for the darker sides Rd=32.5±0.2 and a=51.9±0.4.

C. Results

Effect of Carbonate

Figure 15:
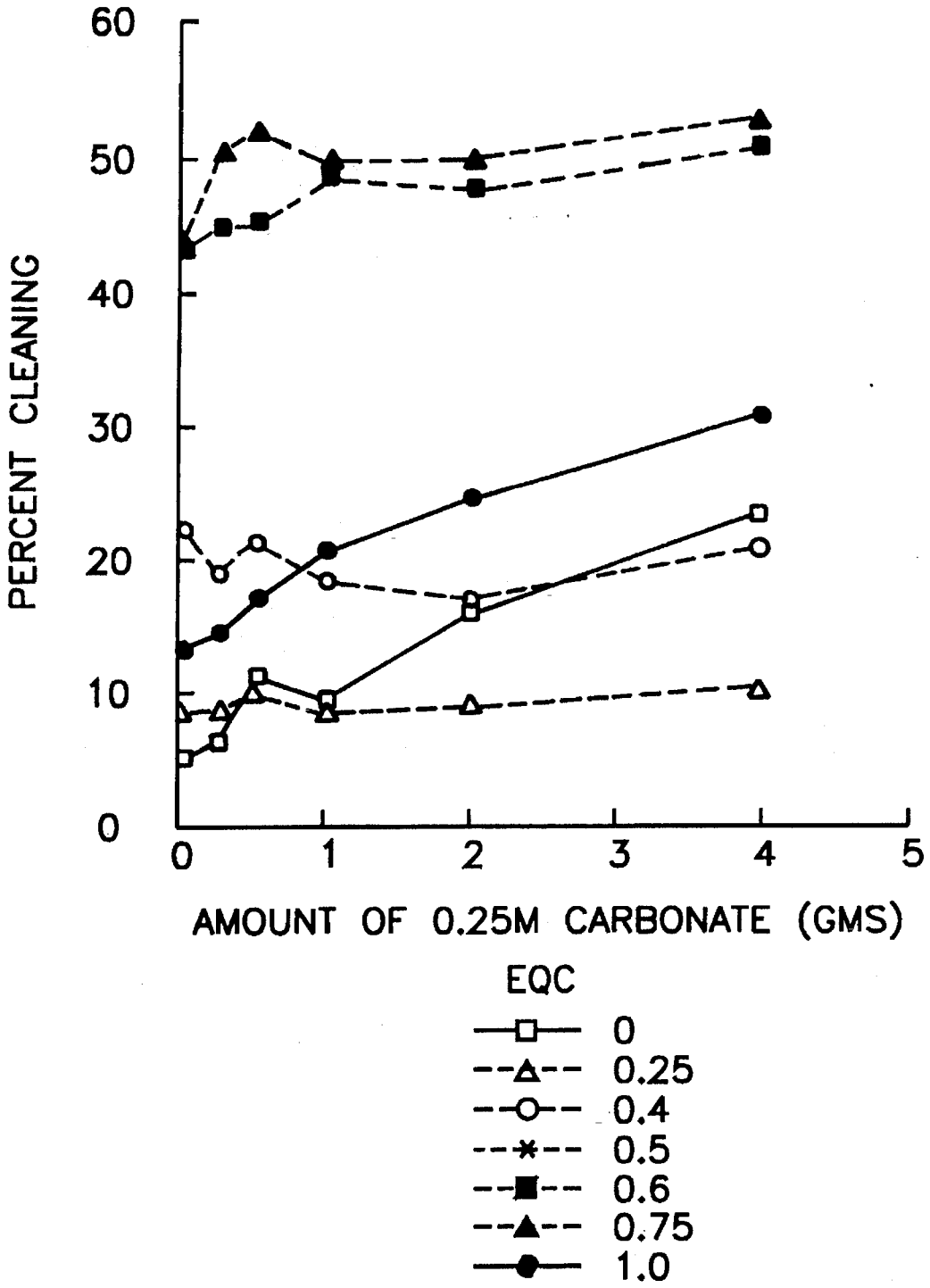
FIG. 15 is a graph of Crisco detergency vs. builder concentration for various aqueous solutions of anionic/cationic mixture plus builder.

The effect of sodium carbonate on detergency of Crisco was found to depend on the anionic/cationic surfactant mole ratio. While it increased the detergency of surfactant mixtures with some mole fractions it was ineffective with others. FIG. 15 shows the % cleaning of Crisco at 120° F. as a function of sodium carbonate concentrations for several mixtures of soap and Ethoquad C-25, different in mole fractions of the quat. Sodium carbonate has significant effect on systems that are 100% soap and Soap/Ethoquad mixtures with Ethoquad mole fraction >0.5. Two significant features are observed: (a) the large slope for the curves representing 100% soap (EQC=0) and 100% quat (EQC=1.0) and (b) the initial rise of curves representing quat mole fractions of 0.60 and 0.75.

Figure 16:
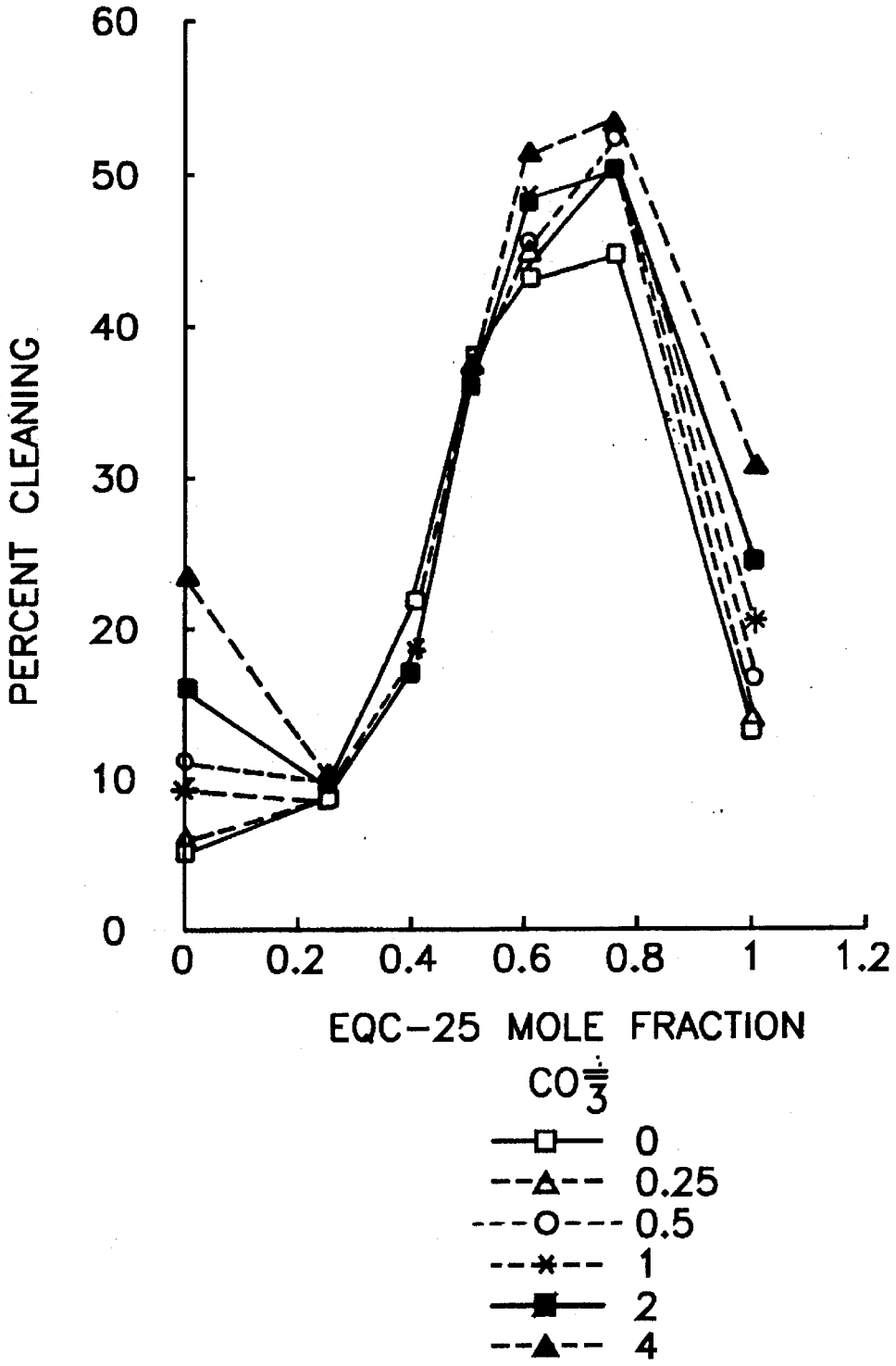
FIG. 16 is a graph of Crisco detergency vs. mole fraction of cationic in various aqueous solutions of anionic/cationic mixture plus builder.

FIG. 16 is a plot of the same data but for percent cleaning vs. cationic surfactant mole fraction for different amounts of sodium carbonate. It shows how the effect of carbonate depends on the relative concentrations of the anionic and cationic surfactants in the surfactant mixture.

There is no definite explanation at this time for the increase in cleaning at 100% soap and 100% quat. We can only speculate as follows. At EQC-25 mole fractions greater than 0.5, carbonate-quat complex may form and be responsible for the slight increase in cleaning. At 100% soap (EQC=0) the increased detergency with increase in carbonate concentration may be due to increase in pit minimizing the conversion of the soap to its corresponding fatty acid and maximizing conversion to soap of fatty acids that may be present in the Crisco.

Figure 17:
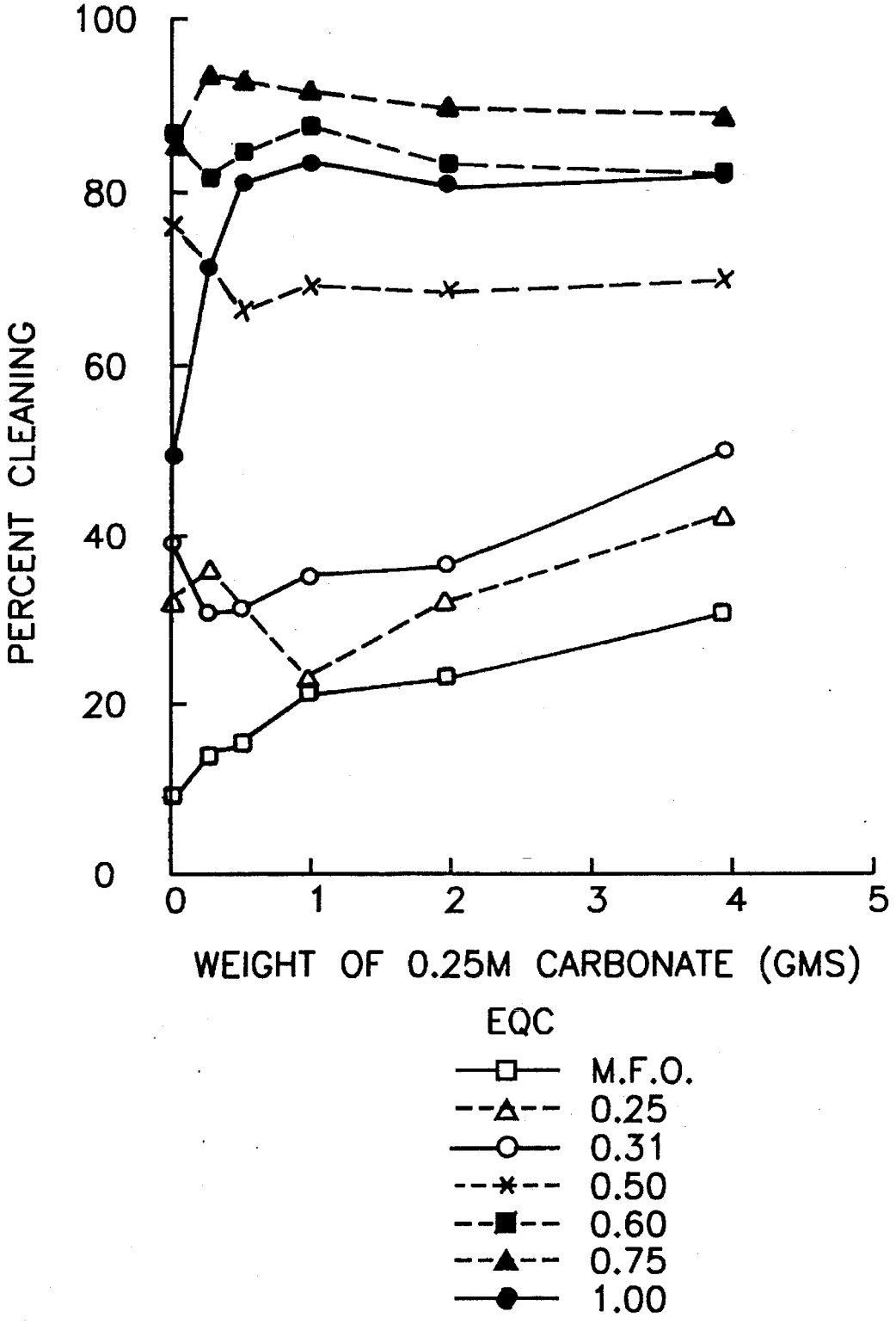
FIG. 17 is a graph of sebum detergency vs. builder concentration for various aqueous solutions of anionic/cationic mixture plus builder.
Figure 18:
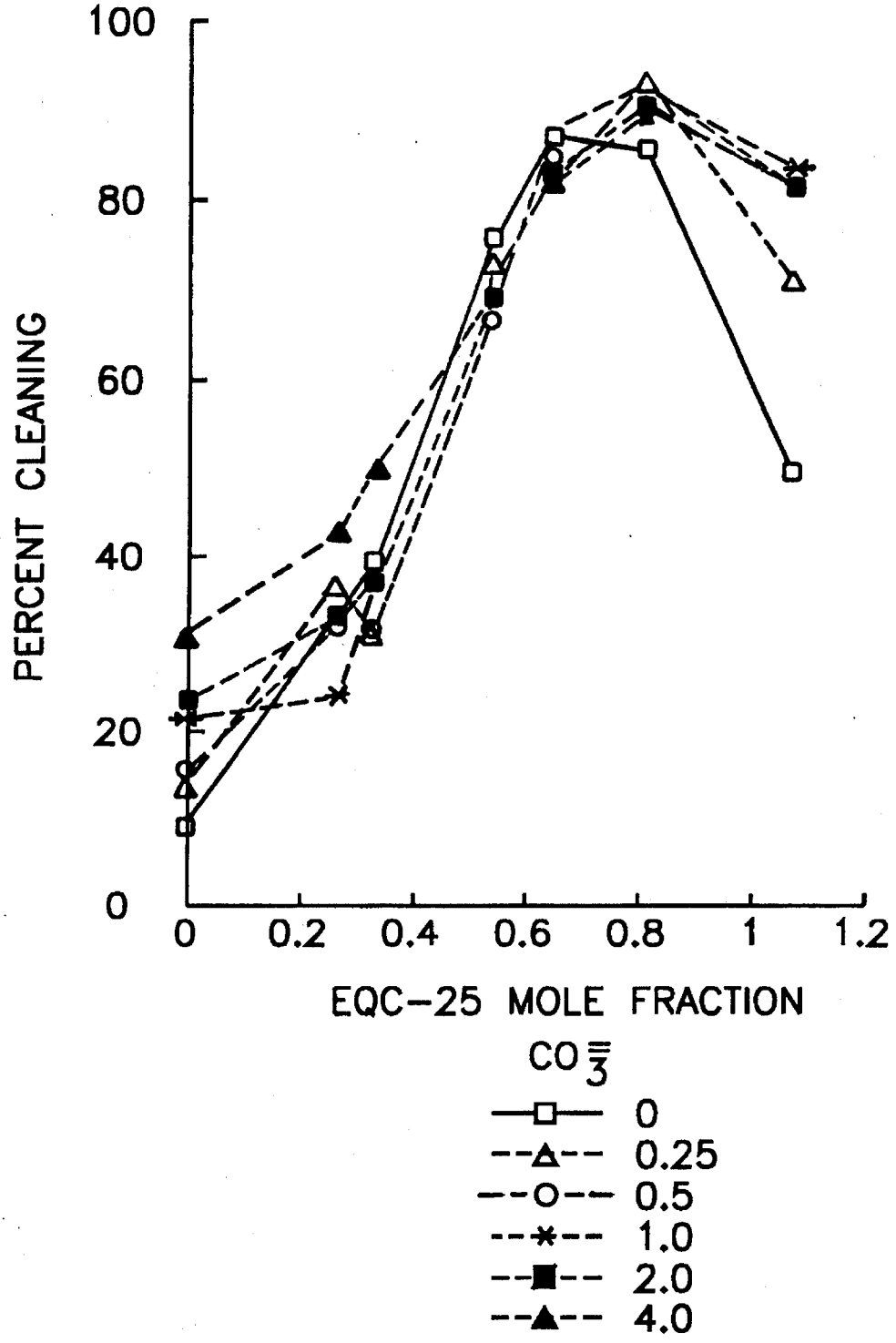
FIG. 18 is a graph of sebum detergency vs. mole fraction of cationic in various aqueous solutions of anionic/cationic mixture plus builder.

The effect of carbonate on sebum was also complicated and depended on the mole fraction of the cationic surfactant (FIGS. 17 and 18). FIG. 17 shows the % cleaning of sebum at 74° F. as a function of carbonate concentration for various combinations of soap and Ethoquad C-25. At mole fractions of less than or equal to 0.6 detergency decreased slightly with additions of small amounts of carbonate but gradually increased with the addition of more carbonate. At 0 cationic surfactant (100% soap) no initial decrease was noticed. At mole fractions greater than 0.6, detergency initially increased with increase in carbonate but eventually decreased with increase in more carbonate.

Figure 19:
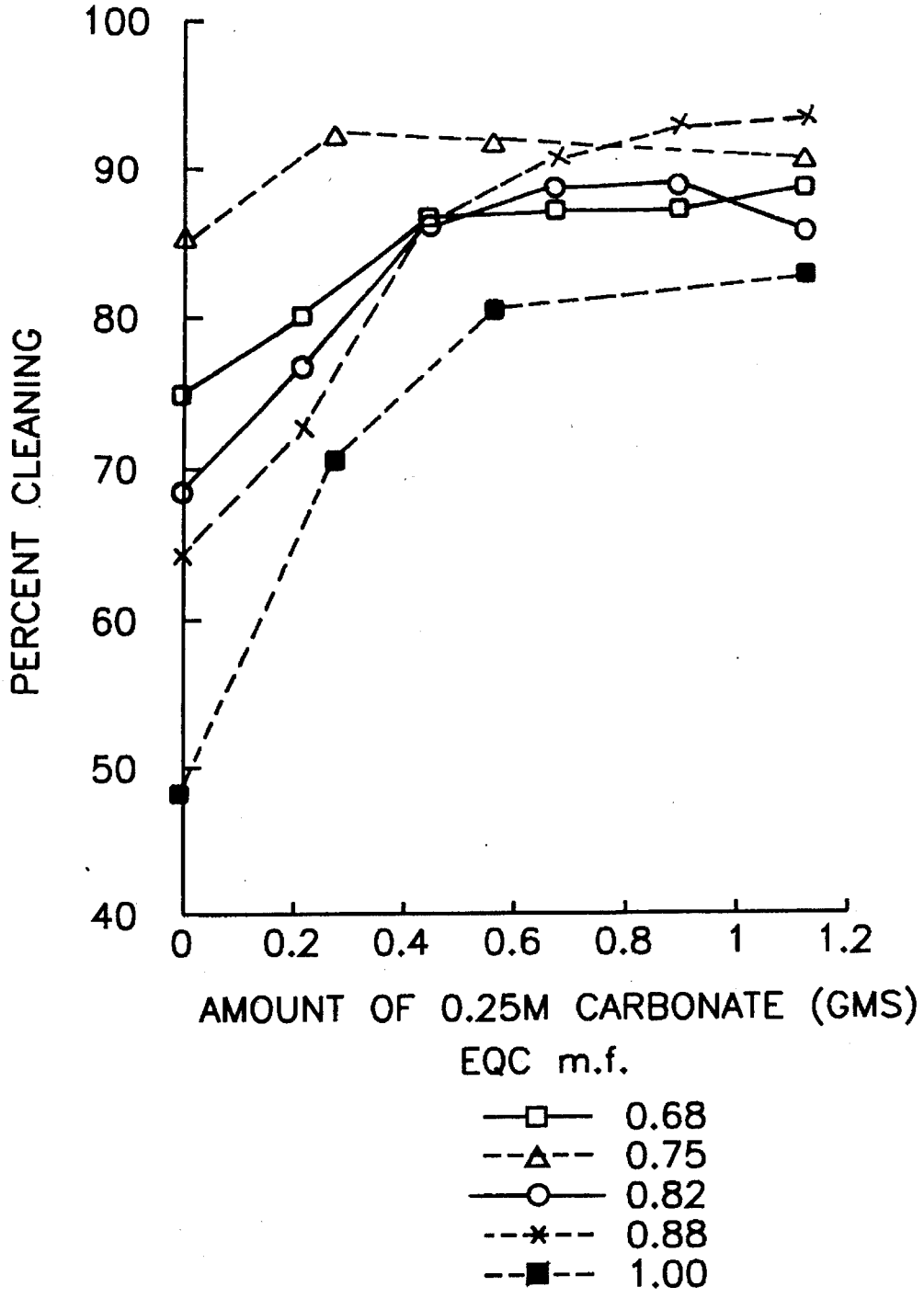
FIG. 19 is a graph of sebum detergency vs. builder concentration for various aqueous solutions of anionic/ cationic mixture plus builder.

In order to confirm this initial increase, more detergency evaluations were performed with systems containing low concentrations of carbonate and high cationic surfactant mole ratios. FIG. 19 shows the detergency increase with increase in small amount of carbonate for EQC-25 mole ratios of 0.68 and greater. The increase was proportional to deviation from 0.6 of the cationic mole fraction.

Effect of Temperature

The effect of temperature on detergency was found to depend on the type of soil and surfactant system (anionic, cationic or complex). FIGS. 20 and 21 show the % cleaning of red Crisco shortening and sebum respectively as a function of temperature for three surfactant systems, i.e. anionic, cationic and anionic/cationic complex. As shown in FIG. 20, neither soap nor EQC-25 can clean Crisco at any temperature. However, a mixture of the two surfactants cleans it and the cleaning effectiveness increases with increase in washing temperature. On the other hand, as shown in FIG. 21, sebum is cleaned not only by the mixture, but also by EQC-25 but not by the soap. Moreover, in general, detergency of sebum increased with decrease in washing temperature.

Sebum Detergency of Ethoxylated Quats

The performance of a combination of the anionic and cationic surfactants was in general much better than that of either the anionic or cationic surfactants alone. The cleaning of the Crisco stained swatches were low when washed with the systems containing either excess anionic surfactants or excess ethoxylated surfactants (FIG. 2). For the sebum stained swatches, however, good cleaning was maintained even with systems containing excess ethoxylated cationic surfactants, i.e. mole fraction greater than 0.8 (FIG. 18). This cleaning effect is enhanced by the addition of more sodium carbonate. The sustained cleaning at high cationic mole fraction may be due to the complexation of the excess ethoxylated cationic surfactants with the fatty acids of the sebum. This demonstrates that ethoxylated cationic surfactants could offer additional advantages when they are part of a complex because common oily soils such as sebum have anionic components, namely fatty acids.

The composition of the sebum part in a sebum/particulate soil from Colgate Laundry Lab is shown in Table IV. Table IV shows that sebum contains about 30% fatty acids (10% oleic, 5% linoleic, 10% palmitic and 5% stearic). The fatty acids may combine with the ethoxylated cationic surfactants to form soluble complexes which, in addition to removing the fatty soils, will result in complexes capable of removing additional oily soils. This was enhanced in the presence of carbonate at high ethoxylated mole fraction. Carbonate enhanced soap formation of the fatty acids in sebum which in turn increased soap/gust complexation. The resulting complexes like any other pseudo-nonionic complexes must have cloud points whose solubility decreases at high temperatures resulting in less cleaning.

TABLE IV

Sebum Composition

| Substance | Percentage |
|---|---|
| Palmitic Acid | 10.0 |
| Stearic Acid | 5.0 |
| Coconut Oil | 15.0 |
| Paraffin | 10.0 |
| Spermwax, Synthetic | 15.0 |
| Olive Oil | 20.0 |
| Squalene | 5.0 |
| Cholesterol | 5.0 |
| Oleic Acid | 10.0 |
| Linoleic Acid | 5.0 |

Comparative Detergency of Anionic/Cationic Complexes

Effect of Structure and Temperature

The effect of temperature on sebum detergency of different anionic-cationic complexes is shown in FIG. 22. The inverse relationship of sebum detergency to washing temperature was observed for most of the complexes tested. Detergency was found to be higher when the additional hydrophilic group is on the cationic surfactant than when it is on the anionic surfactant (FIG. 23). In addition, it increased with increase in the size of the hydrophilic portion relative to the hydrophobic portion of the cationic surfactant. Thus detergency followed the order of hydrophilicity, i.e. $C_{12}$TAB/AEOS>$C_{14}$TAB/AEOS and EQC-25/soap> EQ 18-25/soap>EQ 18-20/soap>EQ 18-15/soap for almost all the temperatures (FIG. 24). This observation as well as the previous observation that sebum is cleaned well with 100% EQC-25 suggests that ethoxylated quats complex with the fatty acid components of the sebum. Because the fatty acids are mainly long chain ($C_{18}$), the solubility (cloud point) of their ethoxylated quat complexes are sensitive to temperature.

For Crisco the trend was in the opposite direction with the exception of EQ 18-15/soap (FIG. 25). Its detergency decreased with increase in hydrophilicity of the complex unlike sebum detergency (compare to FIG. 9) i.e. $C_{12}$TAB/AEOS<$C_{14}$TAB/AEOS and EQC-25/soap<EQ 18-25/soap<EQ 18-20/soap<EQ 18-15/soap. It is important to note that the cloud point of the EQ 18-15/soap was very low, and was insoluble at all washing temperatures, thus less cleaning for both Crisco and sebum.

From FIG. 26, it is seen that overall cleaning performance (on Dacron double knit fabric) against a variety of oily soils (French dressing, barbecue sauce and Crisco oil) reaches a sharp maximum at about a 1:1 mole ratio for the AEOS/TTAB complex.

What is claimed is:

1. A water-soluble complex comprising at least one cationic surfactant having the formula:

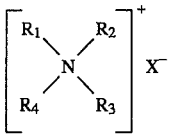

where $R_1$ is an alkyl or alkenyl radical containing from about 8 to about 22 carbon atoms, $R_2$ is an alkyl group of not more than 6 carbon atoms, $R_3$ and $R_4$ each represent $(R_5O)_n$ H, wherein n is 1 to 25, $R_5$ is an alkylene of 2 to 4 carbon atoms and the total number of $R_5O$ groups is at least 5, and X is halide; and at least one anionic surfactant having the formula:

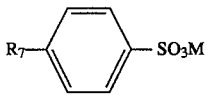

wherein $R_7$ is an alkyl radical of from 8 to about 18 carbon atoms, and

M is an alkali metal, ammonium or amine, wherein the ratio of anionic surfactant to cationic surfactant is about 1:1.

2. A water-soluble complex comprising at least one anionic surfactant and at least one cationic surfactant;

wherein said at least one cationic surfactant has the formula:

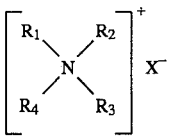

where $R_1$ is an alkyl or alkenyl radical containing from about 8 to about 22 carbon atoms, $R_2$ is an alkyl group of not more than 6 carbon atoms, $R_3$ and $R_4$, which may be the same or different, are selected from the group consisting of alkyl of not more than 6 carbon atoms and $(R_5O)_nH$ wherein $R_5$ is an alkylene of 2 to 4 carbon atoms and n is a number of from 1 to 25 and the total number of $R_5O$ groups is at least 5, and X is a water-soluble, salt-forming anion; and said at least one anionic surfactant having the formula:

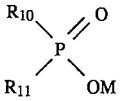

wherein $R_{10}$ is $R_{12}$ —$O(R_5O)_o$, $R_{11}$ is $R_{12}$ —$O(R_5O)_o$ or —OM $R_5$ is an alkylene of 2 to 4 carbon atoms, o is an number of 1 to 25, $R_{12}$ is a hydrocarbon radical from about 8 to about 22 carbon atoms, and M is a water-soluble cation, wherein the ratio of anionic surfactant to cationic surfactant is about 1:1.

3. A water-soluble complex comprising at least one anionic surfactant and at least one cationic surfactant;

wherein said at least one cationic surfactant having the formula:

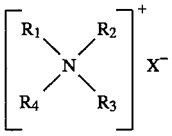

where $R_1$ is an alkyl or alkenyl radical containing from about 8 to about 22 carbon atoms, $R_2$ is an alkyl group of not more than 6 carbon atoms, $R_3$ and $R_4$, which may be the same or different, are selected from the group consisting of alkyl of not more than 6 carbon atoms, X is a water-soluble, salt-forming anion; and said at least one anionic surfactant having the formula:

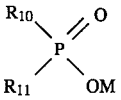

wherein $R_{10}$ is $R_{12}$ —$O(R_5O)_o$, $R_{11}$ is $R_{12}$ —$O(R_5O)_o$ or —OM $R_5$ is an alkylene of 2 to 4 carbon atoms, o is an number of 1 to 25 and the total number of $R_5O$ groups is at least 5, $R_{12}$ is a hydrocarbon radical from about 8 to about 22 carbon atoms, and M is a water-soluble cation, wherein the ratio of anionic surfactant to cationic surfactant is about 1:1.

* * * * *